US006744334B1

(12) United States Patent
Marumoto

(10) Patent No.: US 6,744,334 B1
(45) Date of Patent: Jun. 1, 2004

(54) PHASE SHIFTER CAPABLE OF MINIATURIZING AND METHOD OF MANUFACTURING THE SAME

(75) Inventor: Tsunehisa Marumoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/089,602

(22) PCT Filed: Sep. 28, 2000

(86) PCT No.: PCT/JP00/06708

§ 371 (c)(1),
(2), (4) Date: Aug. 28, 2002

(87) PCT Pub. No.: WO01/24307

PCT Pub. Date: Apr. 5, 2001

(30) Foreign Application Priority Data

Sep. 30, 1999 (JP) ..... 11-279680

(51) Int. Cl.[7] ..... H01P 1/18
(52) U.S. Cl. ..... 333/156; 333/164
(58) Field of Search ..... 333/156, 164, 333/161, 246, 103, 262, 138, 137, 139, 140, 100, 109

(56) References Cited

U.S. PATENT DOCUMENTS 4,458,219 A * 7/1984 Vorhaus ..... 333/164

FOREIGN PATENT DOCUMENTS

JP 9-213191 A 8/1997

OTHER PUBLICATIONS

Patent Abstracts of Japan, Publication No. 2000–311573 published Nov. 7, 2000.

Patent Abstracts of Japan, Publication No. 2000–311573, published Nov. 7, 2000.

* cited by examiner

*Primary Examiner*—Brian Young
*Assistant Examiner*—Joseph Lauture
(74) *Attorney, Agent, or Firm*—Sughrue Mion, PLLC

(57) ABSTRACT

A phase shifter for switching passing phase of a high-frequency signal by means of ON/OFF control of a micro-machine switch, the micro-machine switch comprising cantilevers (11*a*), (11*b*) with one ends thereof connected to a second distributed constant line (3*a*), (3*b*) and the other ends thereof formed to be capable of coming toward and away from the other of a first distributed constant line (2*a*), (2*b*). The micro-machine switch further comprises a first insulating section formed in a region where the first distributed constant line (2*a*), (2*b*) faces the cantilevers (11*a*), (11*b*), and a second insulating section (15*a*), (15*b*) for keeping a voltage value of a first control signal together with the first insulating section.

107 Claims, 28 Drawing Sheets

PHASE SHIFTER CAPABLE OF MINIATURIZING AND METHOD OF MANUFACTURING THE SAME

TECHNICAL FIELD

The present invention relates to a phase shifter for switching passing phase of a high-frequency signal with ON/OFF control of a switching element, and, in particular, to a phase shifter, in which a micro-machine switch is used as a switching element.

BACKGROUND OF THE INVENTION

Recently, the possibility of use of micro-machine switches for switching elements used in phase shifter has been indicated. The micro-machine switches are finely machined switching elements. The micro-machine switches are featured in less loss, low cost and small electric power consumption as compared with other elements. This kind of micro-machine switch is disclosed in, for example, Japanese Patent Laid-Open No. 17300/1997.

FIG. 1 is a plan view showing a phase shifter making use of a micro-machine switch described in the above-mentioned Japanese Patent Publication. In addition, a wavelength of a high-frequency signal RF transmitting through a main line 201 is assumed to be λ. The phase shifter shown in FIG. 1 is a low deadline type phase shifter. More specifically, the main line 201 connects thereto two stubs 202*a*, 202*b*, which are opened at tip ends thereof and spaced away λ/4 from each other. Further, other stubs 203*a*, 203*a* wit tip ends opened are arranged to be spaced from the stubs 202*a*, 202*b*. A micro-machine switch 209*a* having a contact 215 is arranged between the stubs 202*a*, 202*b*. Also, a micro-machine switch 209*b* having a contact 215 is arranged between the stubs 202*b*, 203*b*.

The micro-machine switches 209*a*, 209*b* are put in OFF position, only the stubs 202*a*, 202*b* are loaded on the main line 201. Meanwhile, when the micro-machine switches 209*a*, 209*b* are put in ON positions the stubs 203*a*, 203*b* are further loaded on the main line 201 through the contact 215 of the micro-machine switches 209*a*, 209*b*. Accordingly, the stubs loaded on the main line 201 can be changed in electric length by making ON/OFF control on the micro-machine switches 209*a*, 209*b*.

Susceptance on a side of the stubs from the main line 201 varies depending upon the electric length of the stubs being loaded. Meanwhile, passing phase of the main line 201 varies in accordance with such susceptance. Accordingly, the high-frequency signal RF transmitting through the main line 201 can be switched over in passing phase by making ON/OFF control on the micro-machine switches 209*a*, 209*b*.

With reference to FIGS. 2 and 3, an explanation will be given below to a constitution of and an operation of the micro-machine switch 209*b* shown in FIG. 1. FIG. 2 is a plan view showing the micro-machine switch 209*b* in enlarged scale. FIGS. 3(A) to (C) are cross sectional views of the micro-machine switch 209*b*, FIG. 3(A) being a cross sectional view taken along the line C-C' in FIG. 2. FIG. 3(B) being a cross sectional view taken along the line D-D' in FIG. 2, and FIG. 3(C) being a cross sectional view taken along the line E-E' in FIG. 2.

The stubs 202*b*, 203*b* are formed on a substrate 210 in a manner to provide a slight gap therebetween. A lower electrode 211 is formed on the substrate 210 in a position spaced from the stubs 202*b*, 203*b*. Also, a post 212 is formed on the substrate 210 in a position on an extension of a line segment connecting the gap between the stubs 202*b*, 203*b* to the lower electrode 211.

A base portion of an arm 213 is fixed to a top surface of the post 212. The arm 213 extends from the top surface of the post 212 to a region above the gap between the stubs 202*b*, 203*b* through a region above the lower electrode 211. The arm 213 is formed from an insulating material. An upper electrode 214 is formed on an upper surface of the arm 213. The upper electrode 214 extends from a region above the post 212 to a region above the lower electrode 211. A contact 215 is formed on an underside of a tip end of the arm 213. The contact 215 is formed to extend from a region above an end of the stub 202*b* to bridge the gap to further extend to a region above an end of the stub 203*b*.

Further, a control signal line 204 is connected to the lower electrode 211. A control signal is applied to the lower electrode 211 from the control signal line 204. The control signal serves to make ON/OFF control of the micro-machine switch 209*b* for switching of connection of the stubs 202*b*, 203*b*.

It is assumed that voltage is applied to the lower electrode 211 as the control signal. In this case, if, for example, positive voltage is applied to the lower electrode 211, positive charges are generated on a surface of the lower electrode 211 and electrostatic induction causes negative charges to be generated on an underside of the upper electrode 214, which faces the lower electrode 211. As a result, attractive forces between the both electrodes cause the upper electrode 214 to be drawn toward the lower electrode 211. Thereby, the arm 213 bends and the contact 215 displace downward. And when the contact 215 comes into contact with both the stubs 202*b*, 203*b*, the stubs 202*b*, 203*b* connect to each other via the contact 215 in high-frequency fashion.

Meanwhile, when application of positive voltage on the lower electrode 211 is stopped, attractive forces disappear, so that restoring forces of the arm 213 returns the contact 215 to its original position. Thereby, there is produced an opened state between the stubs 202*b*, 203*b*.

In addition, the micro-machine switch 209*a* shown in FIG. 1 is also constituted and operates in the same manner as the micro-machine switch 209*b*.

The micro-machine switch 209*b* shown in FIG. 1 necessitates the post 212 and the arm 213 for supporting of the contact 215, in addition to the contact 215 for connecting/opening between the stubs 202*b*, 203*b*. Also, the lower electrode 211 and the upper electrode 214 are further needed to control displacement of the contact 215. Therefore, the micro-machine switch 209*b* is large and complex in three-dimensional structure. The same is the case with the micro-machine switch 209*a*.

When such micro-machine swatches 209*a*, 209*b* are used in a phase shifter, there is caused a problem that arrangement of the micro-machine switches 209*a*, 209*b* requires a large area to lead to large-sizing of the entire phase shifter. Also, manufacture of the micro-machine switches 209*a*, 209*b* having a complex construction necessitates many processes, and so the manufacturing processes for phase shifters become complex.

Therefore, an object of the present invention is to miniaturize a phase shifter, which makes use of micro-machine switches as a switching element.

Another object of the present invention is to simplify the construction of a phase shifter, which makes use of micro-machine switches as a switching element.

DISCLOSURE OF THE INVENTION

A phase shifter according to the present invention switches passing phase of a high-frequency signal by means of ON/OFF control of micro-machine switches.

A micro-machine switch according to a first example of the present invention comprises first and second distributed constant lines arranged on a substrate to be spaced from each other, a first control signal line connected electrically to the first or second distributed constant line for application of a first control signal composed of a binary change in voltage. The micro-machine switch also comprises a cantilever, one end of which is fixed to one of the first and second distributed constant lines and the other end of which is formed to be capable of coming toward and away from the other of the first and second distributed constant lines, the cantilever comprising an electrically conductive member. The micro-machine switch further comprises a first insulating section formed in a region where the other of the first and second distributed constant lines faces the cantilever, and a second insulating section for keeping a voltage value of the first control signal together with the first insulating section.

The cantilever unites the function as a movable contact and the function as a support for the movable contact. Accordingly, the cantilever corresponds to the contact 215, the arm 213 and the post 212 of a conventional micro-machine switch in terms of function, and the former can be formed to be small as compared with the latter and is simpler than the latter.

Also, the first control signal is applied to the first or second distributed constant line to control an action of the cantilever, so that the lower electrode 211 and the upper electrode 214, which have been conventionally necessary, are made unnecessary. In this regard, the micro-machine switch can be made small in size and simple in construction.

On the other hand, it is essential in the invention to provide a first insulating section for capacitive coupling and a second insulating section for holding of control voltage. However, it is possible according to the present invention to make small-sized a phase shifter making use of the micro-machine switch and to simplify the phase shifter simple in construction.

Also, a phase shifter according to a second example of the present invention comprises a main line, through which a high-frequency signal is transmitted, and a first distributed constant line connected to the main line and opened at a tip end thereof. The phase shifter also comprises a second distributed constant line arranged to be spaced from the tip end of the first distributed constant line and opened at a tip end thereof. The phase shifter further comprises a cantilever, one end of which is fixed to one of the first and second distributed constant lines and the other end of which is formed to be capable of coming toward and away from the other of the first and second distributed constant lines, the cantilever comprising an electrically conductive member. The phase shifter further comprises a first control signal line connected electrically to the first or second distributed constant line and for applying of a first control signal composed of a binary change in voltage, a first insulating section formed in a region where the other of the first and second distributed constant lines faces the cantilever, and a second insulating section for keeping a voltage value of the first control signal together with the first insulating section.

A phase shifter according to a third example of the present invention comprises a main line, through which a high-frequency signal is transmitted, a first distributed constant line connected to the main fine and opened at a tip end thereof, and a grounding arranged to be spaced from the tip end of the first distributed constant line. The phase shifter also comprises a cantilever, one end of which is fixed to one of the first and second distributed constant lines and the other end of which is formed to be capable of coming toward and away from the other of the first and second distributed constant lines, the cantilever comprising an electrically conductive member. The phase shifter further comprises a first control signal line connected electrically to the first or second distributed constant line and for applying of a first control signal composed of a binary change in voltage, a first insulating section formed in a region where the other of the first and second distributed constant lines faces the cantilever, and a second insulating section for keeping a voltage value of the first control signal together with the first insulating section.

In accordance with the first to third examples, a low deadline type phase shifter can be constituted. In the case where a low deadline type phase shifter is to be constituted, the second insulating section is constituted by two capacitors formed midway the main line, and both the first and second distributed constant lines and the first control signal line are enabled to be connected electrically to the main line between the two capacitors.

Alternatively, the first control signal line may be connected electrically to the second distributed constant line, and the second insulating section may be constituted by the open end of the second distributed constant line.

A phase shifter according to a fourth example of the present invention includes a first distributed constant line with a cut part, two second distributed constant lines having different electric length, and a micro-machine switch for switching the second distributed constant lines, which short-circuits the cut part of the first distributed constant line to vary passing phase of a high-frequency signal. The micro-machine switch comprises cantilevers provided every second distributed constant line, one ends of the cantilevers being fixed to one of the first and second distributed constant lines and the other ends of the cantilevers being formed to be capable of coming toward and away from the other of the first and second distributed constant lines, the cantilevers comprising electrically conductive members. The micro-machine switch also comprises a second control signal line connected electrically to one of the second distributed constant lines for application of a second control signal composed of a binary change in voltage, and a third control signal line connected electrically to the other of the second distributed constant lines for application of a third control signal complementary to the second control signal. The micro-machine switch further comprises first insulating sections, respectively, formed in regions where the other of the first and second distributed constant lines faces the cantilevers, and a second insulating section for keeping a voltage value of the second and third control signals together with the first insulating sections. In the micro-machine switch, the second and third control signal lines constitute a first control signal line.

A phase shifter according to a fifth example of the present invention includes a first distributed constant line with a cut part two second distributed constant lines having different electric length, and a micro-machine switch for switching the second distributed constant lines, which short-circuit the cut part of the first distributed constant line to vary passing phase of a high-frequency signal. The micro-machine switch comprises cantilevers provided every second distributed constant line, one ends of the cantilevers being fixed to one of the first and second distributed constant lines and the other ends of the cantilevers being farmed to be capable of coming toward and away from the other of the first and second distributed constant lines, the cantilevers comprising electrically conductive members. The micro-machine switch also comprises a first control signal line connected electrically to the first distributed constant line for application of a first control signal composed of a binary change in voltage. The micro-machine switch further comprises first insulating sections, respectively, formed in regions where the other of the first and second distributed constant lines faces the cantilevers, and a second insulating section for keeping a voltage value of the first control signal together with the first insulating sections. In the micro-machine switch, constant voltages, respectively, equivalent to respective voltage values of two states of the first control signal are applied to the respective second distributed constant lines.

With the above-mentioned constitution, it is possible to constitute a switched-line type phase shifter. In these cases, the cantilevers, respectively, may be provided on both ends of the respective second distributed constant lines.

In the above-mentioned cases, a first constituent example of the first insulating section is an insulating film formed on at least one of an upper surface of the other of the first and second distributed constant lines and an underside of the cantilever. Thereby, the first insulating section can be simply constituted.

Also, the phase shifter described above may comprise a first high-frequency signal blocking unit connected to the first control signal line to block passage of the high-frequency signal.

In this case, a first constituent example of the first high-frequency signal blocking unit comprises a high-impedance line connected at one end thereof to that one of the first and second distributed constant lines, to which the first control signal line is connected electrically, and having an electric length of about one fourth as long as a wavelength of the high frequency signal and a greater characteristics impedance than those of the first and second distributed constant lines. The first constituent example comprises a low-impedance line connected at one end thereof to the other of the high-impedance line and opened at the other thereof, and having an electric length of about one fourth as long as the wavelength of the high-frequency signal and a smaller characteristics impedance than that of the high-impedance line. In this case, the first control signal line is connected to the other end of the high-impedance line.

A second constituent example of the first high-frequency signal blocking unit comprises a high-impedance line connected at one end thereof to that one of the first and second distributed constant lines, to which the first control signal line is connected electrically, and having an electric length of about one fourth as long as a wavelength of the high-frequency signal and a greater characteristics impedance than those of the first and second distributed constant lines. The second constituent example comprises a capacitor with one of electrodes connected to the other of the high-impedance line and the other of electrodes connected to a grounding. In this case, the first control signal line is connected to the other end of the high-impedance line.

A third constituent example of the first high-frequency signal blocking unit comprises an inductance element.

A fourth constituent example of the first high-frequency signal blocking unit comprises a resistor element having a sufficiently greater impedance than those of the first and second distributed constant lines. In this case, the resistor element may be insertion connected in series to the first control signal line. Alternatively, the resistor element may be connected at one end thereof to the first control signal line and opened at the other end thereof.

In this manner, leak of a high-frequency signal to the first control signal line can be prevented by providing the first high-frequency signal blocking unit on the first control signal line.

Also, the phase shifter described above may comprise a fourth control signal line connected electrically to that one of the first and second distributed constant lines, to which the first control signal line is not, connected electrically, and for charging and discharging electric charges generated by electrostatic induction.

In this manner, the electric charges generated by electrostatic induction is charged and discharged through the fourth control signal line whereby the micro-machine switch is made stable in switching action and increased in switching speed.

Also, the phase shifter described above may comprise a fourth control signal line connected electrically to that one of the first and second distributed constant lines, to which the first control signal line is not connected electrically, and for applying of constant voltage having a reverse polarity to that of to first control signal, and a third insulating section formed on that one of the first and second distributed constant lines, to which the fourth control signal line is connected electrically, and for keeping a voltage value of the constant voltage applied from the fourth control signal line together with the first insulating section.

In this manner, if a predetermined voltage is beforehand applied to that distributed constant line, to which the first control signal is not applied, the first control signal can be correspondingly made small in voltage level.

The phase shifter described above may comprise a second high-frequency signal blocking unit connected to the fourth control signal line to block passage of the high-frequency signal. In this case, a first constituent example of the second high-frequency signal blocking unit comprises a high-impedance line connected at one end thereof to that one of the first and second distributed constant lines, to which the first control signal line is not connected electrically, and having an electric length of about one fourth as long as a wavelength of the high-frequency signal and a greater characteristics impedance than those of the first and second distributed constant lines. The first constituent example also comprises a low-impedance line connected at one end thereof to the other end of the high-impedance line and opened at the other end thereof, and having an electric length of about one fourth as long as the wavelength of the high-frequency signal and a smaller characteristics impedance than that of the high-impedance line. In this case, the fourth control signal line is connected to the other end of the high-impedance line.

A second constituent example of the second high-frequency signal blocking unit comprises a high-impedance line connected at one end thereof to that one of the first and second distributed constant lines, to which the first control signal line is not connected electrically, and having an electric length of about one fourth as long as a wavelength of the high-frequency signal and a greater characteristics impedance than those of the first and second distributed constant lines. The second constituent example also comprises a capacitor with one of electrodes connected to the other of the high-impedance line and the other of electrodes connected to a grounding. In this case, the fourth control signal line is connected to the other end of the high-impedance line.

A third constituent example of the second high-frequency signal blocking unit comprises an inductance element.

A fourth constituent example of the second high-frequency signal blocking unit comprises a resistor element having a sufficiently greater impedance than those of the first and second distributed constant lines. In this case, the resistor element may be insertion connected in series to the fourth control signal line. Alternatively, the resistor element may be connected at one end thereof to the fourth control signal line and opened at the other end thereof.

Leak of a high-frequency signal to the fourth control signal line can be prevented by providing the second high-frequency signal blocking unit on the fourth control signal line as described above.

Also, the phase shifter described above comprises first and second high-impedance lines connected at one ends thereof to the first and second distributed constant lines, and having an electric length of about one fourth as long as a wavelength of the high-frequency signal and a greater characteristics impedance than those of the first and second distributed constant lines. The phase shifter also comprises a capacitor with one of electrodes connected to the other of the first high-impedance line and the other of electrodes connected to the other of the second high-impedance line. In this case, the first high-impedance line may be connected at the other end thereof to the first control signal line, and the second high-impedance line may be connected at the other end thereof to a grounding.

With this constitution, the first high-frequency signal blocking unit is constituted by the first high-impedance line, the capacitor and the grounding. Also, the second high-frequency signal blocking unit is constituted by connecting the second high-impedance line to the grounding.

A method of manufacturing a phase shifter, according to the present invention comprises a first step of forming on a substrate a portion of a main line, a first distributed constant line connected to the portion of the main line, a second distributed constant line, an end of which is spaced from an end of the first distributed constant line, and a control signal line connected to the portion of the main line. The method also comprises a second step of forming a sacrificing layer in a region extending from a gap between the first and second distributed constant lines to the end of the first or second distributed constant line. The method further comprises a third step of forming a first insulating film on that portion of the sacrificing layer, which faces the end of the first or second distributed constant line, and a second insulating film on both ends of the portion of the main line. The method further comprises a fourth step of forming a cantilever of metal on an area extending from that end of the second or first distributed constant line, on which the sacrificing layer is not formed, to the first insulating film on the sacrificing layer, and at the same time forming other portions of the main line on the second insulating film and the substrate; and a fifth step of removing the sacrificing layer.

Thereby, the micro-machine switch described above can be manufactured in a loss number of processes.

BRIEF DESCRIPTION OF THE DRAWINGS

FIGS. 42(A) and 42(B) are cross sectional views showing the first insulating section shown in FIG. 40 at the time of ON.

BEST MODE FOR CARRYING OUT THE INVENTION

First Embodiment

Figure 4:
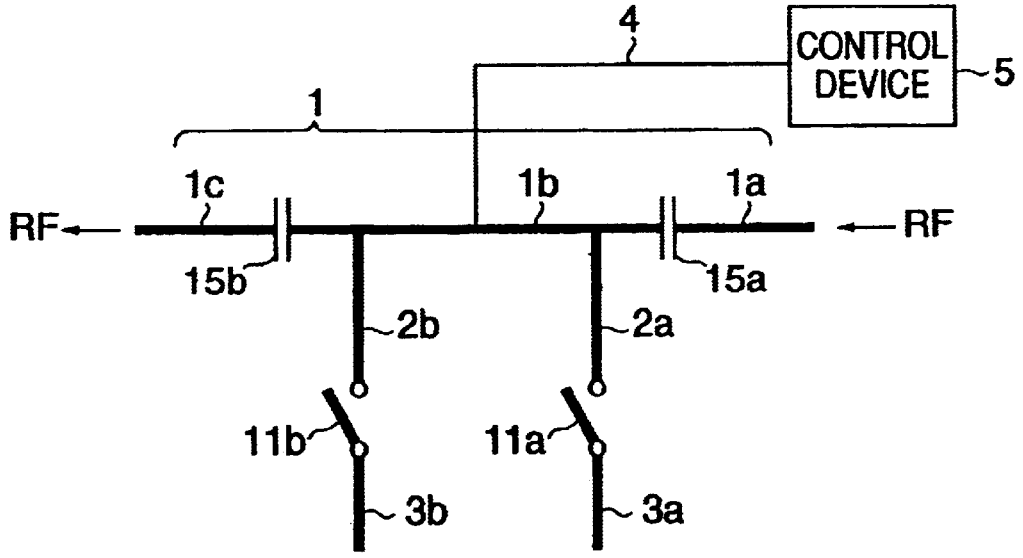
FIG. 4 is a circuit diagram showing a phase shifter according to a first embodiment of the present invention.
Figure 5:
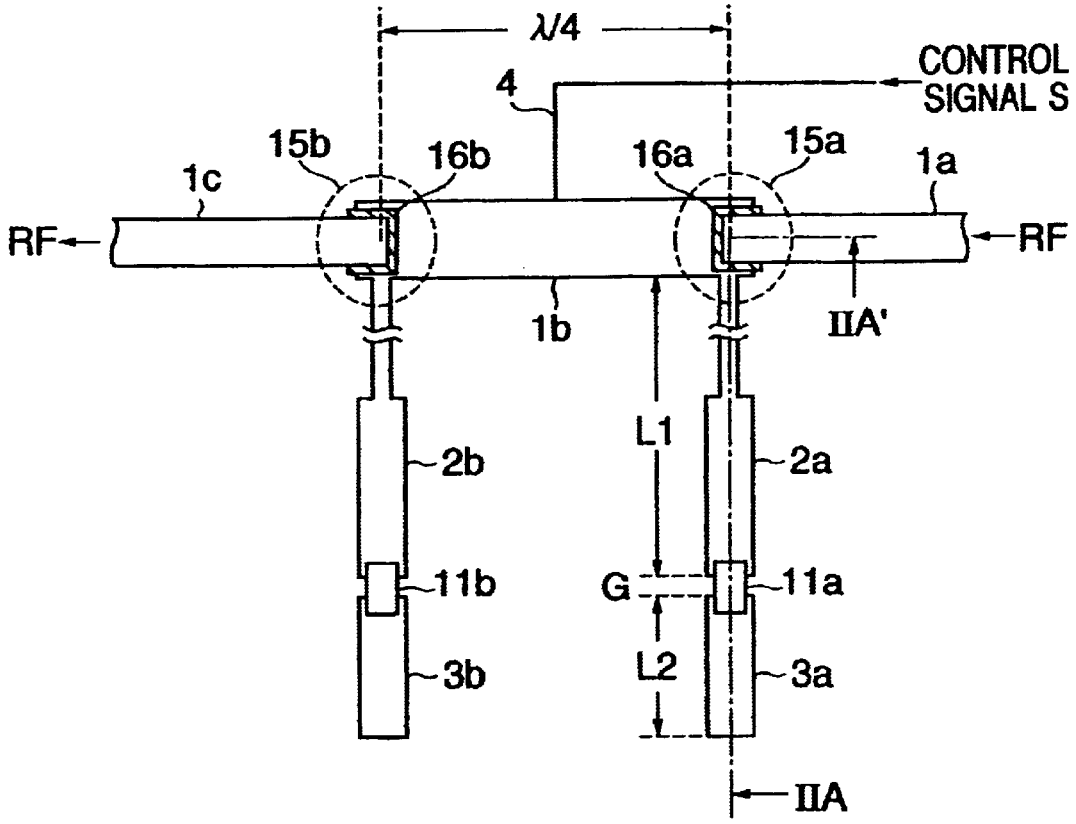
FIG. 5 is a plan view showing the phase shifter shown in FIG. 4.
Figure 6A:
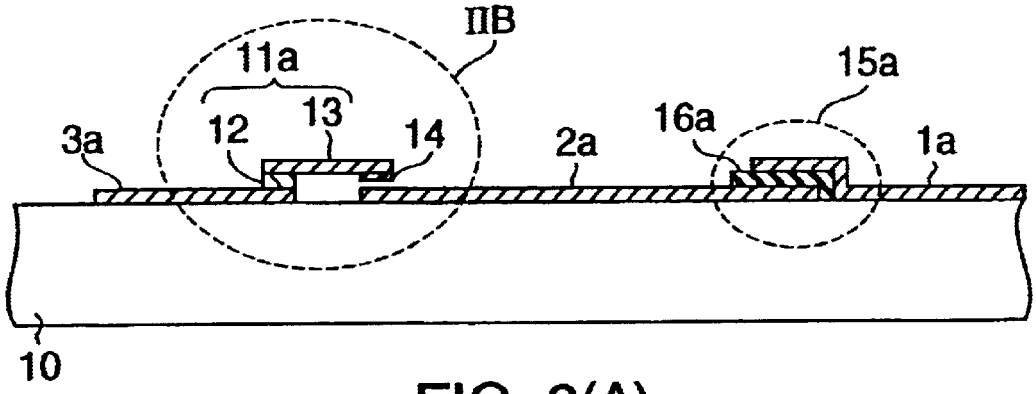
FIGS. 6(A) and (B) are cross sectional views of the phase shifter shown in FIG. 4.
Figure 6B:
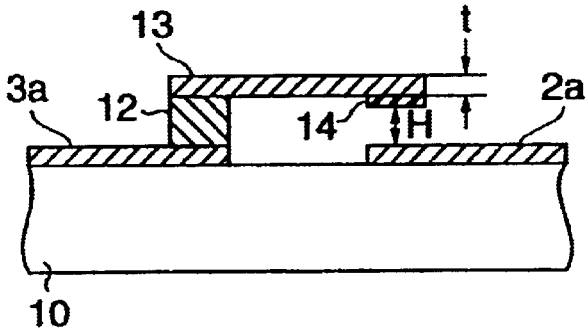
Figure 7:
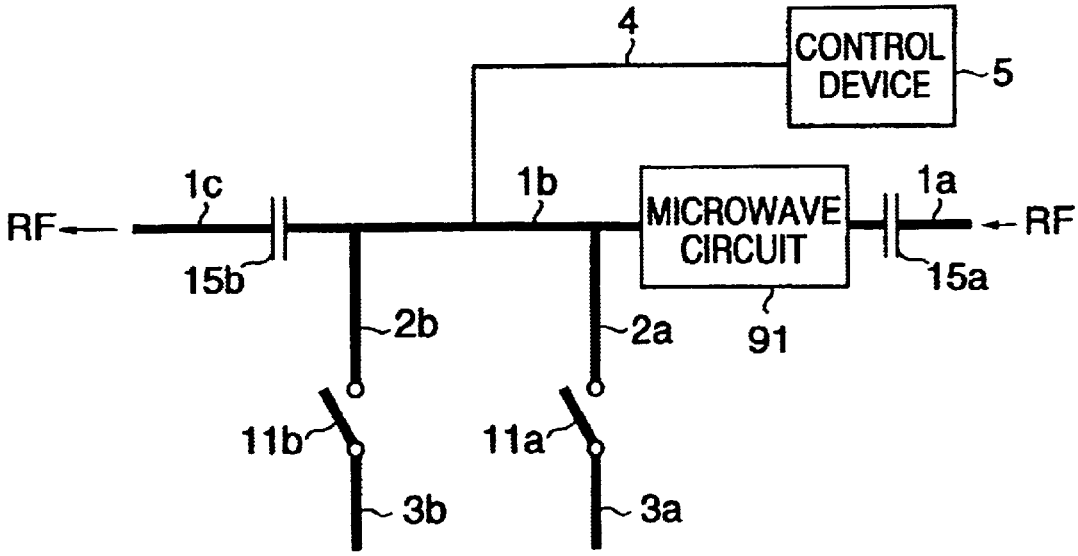
FIG. 7 is a circuit diagram showing a modified configuration of the phase shifter shown in FIG. 4.
Figure 8:
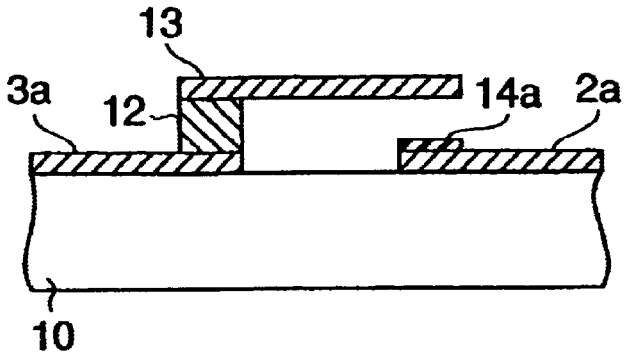
FIG. 8 is a cross sectional view showing a modified configuration of a first insulating section shown in FIGS. 6(A) and (B)
Figure 9:
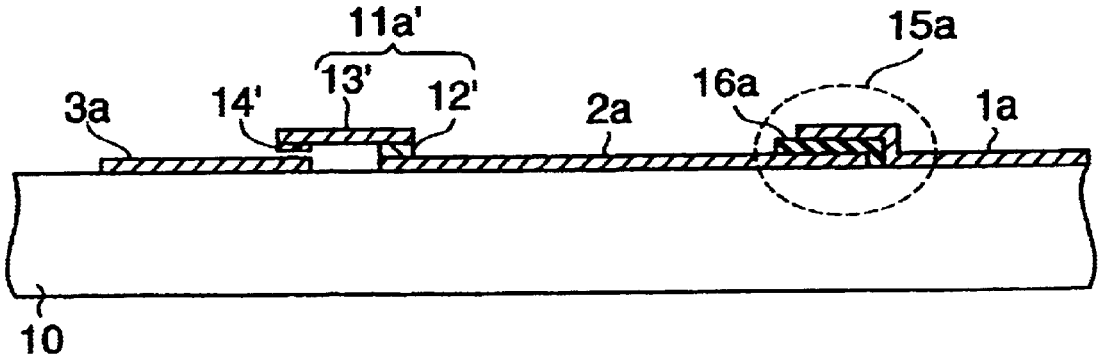
FIG. 9 is a cross sectional view showing a modified configuration of a cantilever shown in FIGS. 6(A) and (B)

With reference to FIGS. 4 and 5, an explanation will be given to a phase shifter according to a first embodiment of the present invention. FIG. 4 is a circuit diagram showing the phase shifter according to the first embodiment of the present invention, and FIG. 5 is a plan view showing the phase shifter. FIG. 6(A) is a cross sectional view taken along the line IIA-IIA' in FIG. 5, and FIG. 6(B) is an enlarged, cross sectional view showing a portion IIB in FIG. 6(A). FIG. 7 is a circuit diagram showing a modification of the phase shifter shown in FIG. 4. Also, FIG. 8 is a cross sectional view showing a modified configuration of a first insulating section shown in FIGS. 6(A) and 6(B). Also. FIG. 9 is a cross sectional view showing a modified configuration of a cantilever shown in FIG. 5.

As shown in FIGS. 4 and 5, a main line 1, through which a high-frequency signal RF is transmitted, is composed of lines 1*a*, 1*b* and 1C. Here, the fine 1*b* is formed at both ends thereof with capacitors 15*a*, 15*b*, respectively. The lines 1*a* and 1*b* are connected to each other through the capacitor 15*a* in high-frequency fashion, and the lines 1*b* and 1*c* are connected to each other through the capacitor 15*b* in high-frequency fashion.

The capacitor 15*a* is formed by overlapping the lines 1*a* and 1*b* vertically with an insulating film 16*a* of $SiO_2$ or the like interposed therebetween as shown in, for example, FIG. 5. The capacitor 15*b* is similarly formed by interposing an insulating film 16*b* between the lines 1*b* and 1*c*.

The capacitors 15*a*, 15*b* also function as a second insulating section for insulating other microwave circuit (not shown) connected to the lines 1*a*, 1*c* from the line 1*b* in direct current or low frequency fashion. Accordingly, coupling capacitors contained in the other microwave circuit may be utilized as a second insulating section. The second insulating section as well as a first insulating section described later also has the function of keeping voltage values of stubs 2*a*, 2*b* at a voltage value of a control signal S described later at the time of connection (ON) of the stubs 2*a*, 3*a*.

In addition, as shown in FIG. 7, another microwave circuit 91 may be connected midway the line 1*b*.

As shown in FIG. 4, two stubs 2*a* and 2*b* (first distributed constant line) with tip ends thereof opened are connected to the line 1*b*, which is a part of the main line 1, with $\lambda/4$ spaced from each other. Here, $\lambda$ is a wavelength of a high-frequency signal RF. Further, other two stubs 3*a* and 3*b* (second distributed constant line), respectively, with tip ends thereof opened are arranged to be spaced away from the tip ends of the stubs 2*a* and 2*b*.

Here, the stubs 2*a* and 2*b* have an electrical length L1, and the stubs 3*a* and 3*b* have an electrical length L2 with a gap G between the stubs 2*a* and 2*b* and the stubs 3*a* and 3*b*.

The main line 1 and the stubs 2*a*, 2*b*, 3*a* and 3*b* described above are formed from a microstrip line of metal, for example, aluminum to be disposed on a substrate 10. In addition, the main line 1 and the stubs 2*a*, 2*b*, 3*a* and 3*b* may be formed from other distributed constant lines such as coplanar lines, triplate lines, slot lines or the like.

Also, the substrate 10 is formed by the use of, for example, a dielectric substrate such as glass substrate or semiconductor substrate such as Si, Ga, As or the like.

A post 12 including an electrically conductive member such as aluminum is formed on an end (end toward the stub 2*a*) of the stub 3*a*. A base portion of an arm 13 is fixed to a top surface of the post 12. The arm 13 extends above a tip end of the stub 2*a* from the top surface of the post 12. The arm 13 is formed from materials, which have electroconductivity and are returned to an original shape even when once curved. The arm 13 is formed from, for example, Al, Au, Cu or the like. The arm 13 may also be formed from silicone, which has electroconductivity due to diffusion of boron. In the following, the post 12 and the arm 13 are referred to as a cantilever 11*a* together.

As described later with reference to FIG. 9 and FIGS. 10(A) to 10(E), the post 12 and the arm 13 may be a single member of the same material to constitute the cantilever 11*a*. Conversely, as shown in FIGS. 6(A) and 6(B), the post 12 and the arm 13 must not be necessarily made of the same material. Each of the post 12 and the arm 13 must not be necessarily made of a single material but may be made of a plurality of materials. Also, in this case, all of the plurality of materials must not be electrically conductive but may partially contain an insulating material. For example, the arm 13 may be of two layered construction, in which a conductive material such as Al and an insulating material such as $SiO_2$ are laminated on one another because of strength. Also, the post 12 may contain an insulating material to an extent that transmission of the high-frequency signal RF is not obstructed.

As shown in FIGS. 6(A) and 6(B), an underside of a tip end of the arm 13, that is, a portion thereof opposed to the stub 2*a* is formed with an insulting film 14 of $SiO_2$ or the like, which serves as the first insulating section. The arm 13 is given a predetermined height by the post 12, and the insulating film 14 formed on the arm 13 is usually (at the time of OFF) spaced away from the stub 2*a*. Conversely, the height of the post 13 is determined so as to usually have the insulating film 14 and the stub 2*a* spaced away from each other.

The first insulating section together with the capacitors 15*a*, 15*b* serves to keep a voltage value of the stub 2*a* at a voltage value of the control signal S described later at the time of connection (ON) of the stubs 2*a*, 3*a*. Accordingly, an insulating film 14*a*, shown in FIG. 8, formed on the top surface of the tip end of the stub 2*a* may be used as the first insulating section. Also, the insulating films 14 and 14*a* nay combine to form the first insulating section.

In addition, there is no need of the voltage value of the stub 2*a* completely corresponding to a voltage value of the control signal S, and the voltage value of the stub 2*a* suffices to be kept to such an extent that the cantilever 11*a* can act based on the control signal S. Also, while a side of the cantilever 11*a* toward the stub 3*a* is fixed in FIGS. 6(A) and 6(B), a side of the cantilever 11*a*' toward the stub 2*a* may be conversely fixed as shown in FIG. 9 in any way, the cantilevers 11*a*, 11*a*' suffice to be constructed such that one ends of the cantilevers are fixed to one of the stubs 2*a*, 3*a* and the other ends of the cantilevers can come toward and away from the other of the stubs 2*a*, 3*a*. As shown in FIG. 4, a cantilever 11*b* and the insulating films 14 and 14*a* are formed on a side of the stubs 2*b*, 3*b* in the same manner as on a side of the stubs 2*a*, 3*a*.

A control device 5 is connected to the line 1*b*, which constitutes a part of the main line 1, through a first control signal line 4. The control device 5 acts to output the control signal (first control signal) S composed of a binary change in voltage. As described later, a state of connection for the stubs 2*a*, 2*b* and the stubs 3*a*, 3*b* is switched over on the basis of the control signal S.

In addition, the first control signal line 4 may not be connected directly to the line 1*b*. For example, the first control signal line 4 suffices to be connected electrically to the line 1*b* as shown in FIGS. 15 and 16 and FIGS. 17 and 18.

In the above manner, a low deadline type phase shifter is constituted.

An explanation will be then given to an operation of a micro-machine switch, which functions as a switching element in the phase shifter shown in FIG. 4. Here, for the sake of convenience, the control signal S is ON/OFF of positive voltage. In addition, an explanation will be given with respect to the stubs 2*a*, 3*a*, and it goes without saying that the same operation is performed on the stubs 2*b*, 3*b*.

As described above, since the insulating film 14 at the tip end of the arm 13 is spaced away from the stub 2*a* at the usual time, high-frequency connection of the stubs 2*a*, 3*a* is opened. At this time, if a positive voltage is applied to the line 1*b* through the first control signal line 4 from the control device 5, positive charges are generated on a surface of the stub 2*a* connected to the line 1*b*. Thereby, electrostatic induction causes negative charges to appear on an underside of the tip end of the arm 13 opposed to the stub 2*a*, and an attracting force is generated between the stub 2*a* and the arm 13. Such attracting force causes the arm 13 to bend toward the substrate 10, and when the insulating film 14 formed on the tip end of the arm 13 comes into contact with the stub 2*a*, capacitive coupling connects the stub 2*a* and the stub 3*a* to each other in high-frequency fashion.

At this time, the capacitors 15*a*, 15*b* insulate the line 1*b* from the lines 1*a*, 1*c* in direct-current or low-frequency fashion. Further, the line 1*b* is insulated from another microwave circuit (not shown) in direct-current or low-frequency fashion. Hence, the control signal S imparted to the line 1*b* will not leak to another microwave circuit, and so will not affect another microwave circuit adversely. At the same time, voltage values of the line 1*b* and the stub 2*a*, which are surrounded by the capacitors 15*a*, 15*b* and the insulating film 14, are maintained.

Meanwhile, when application of positive voltage to the line 1*b* is stopped, the attracting force between the stub 2*a* and the arm 13 disappears. Hence, the arm 13 returns to its original configuration, so that the insulating film 14 is separated from the stub 2*a*. Thereby, high-frequency connection between the stubs 2*a*, 3*a* is released.

Referring to FIG. 6(B), an explanation will be then given to an example of dimensions of the respective parts of the micro-machine switch. Here, the arm 13 is formed of aluminum, and voltage of 40 V is applied as the control signal S.

First, to obtain a desired spring constant in view of strength of the arm 13, a thickness t of the arm 13 is determined to be around 0.5 $\mu$m. Also, a height H between a top of the stub 2*a* and the insulating film 14 formed on the arm 13 is around 5 $\mu$m at normal times. Further, facing areas of the stub 2*a* and of the arm 13 are around 0.01 $mm^2$.

Various dimensions are set in the above manner, and then it becomes possible to realize a micro-machine switch, which operates in the above-mentioned manner. In addition, the dimensions of the respective portions referred to here are only exemplary, and the respective portions are not limited to such dimensions.

An explanation will be then given to a principle of operation of the entire phase shifter shown in FIG. 4. When the control signal S outputted from the control device 5 is OFF, and high-frequency connections between the stubs 2*a*, 3*a* and between the stubs 2*b*, 3*b* are released, only the stubs 2*a*, 2*b* having an electrical length L1 are loaded on the main line 1 composed of the stubs 1*a* to 1*c*.

Meanwhile, when the control signal S is made ON, and high-frequency connections between the stubs 2*a*, 3*a* and between the stubs 2*b*, 3*b* are established, the stubs 3*a*, 3*b* are further loaded on the main line 1 through the cantilevers 11*a*, 11*b*. At this time, the stubs loaded on the main line 1 have an electrical length (L1+L2+G). In this manner, ON/OFF of the control signal S enables changing an electrical length of the stubs loaded on the main line 1.

Susceptance of the stubs as viewed from the main line 1 varies in accordance with an electrical length of the stubs loaded. Meanwhile, the main line 1 varies in passing phase due to such susceptance. Accordingly, the control signal S is made ON/OFF to control high-frequency connections between the stubs 2*a*, 3*a* and between the stubs 2*b*, 3*b*, whereby the high-frequency signal RF transmitting through the main line 1 can be switched in phase-shift amount.

In addition, although the capacitors 15*a*, 15*b* are incorporated midway the main line 1, transmission of the high-frequency signal RF is in no way hindered provided that the capacitors are made adequately large in capacitance.

An explanation will be then given to a method of manufacturing the phase shifter shown in FIG. 4. FIGS. 10(A) to 10(E) and FIGS. 11(A) to 11(D) are cross sectional views showing main processes when the phase shifter according to the embodiment is manufactured. In these figures, a cross section as viewed in the line IIA-IIA' in FIG. 5 is shown.

Figure 10A:
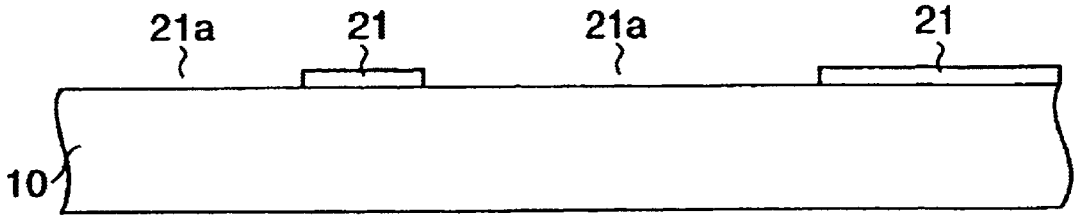
FIGS. 10(A) to 10(E) are cross sectional views illustrating main processes when the phase shifter shown in FIG. 4 is manufactured.

First, photoresist is applied to the substrate 10. The photoresist is subjected to patterning with the known photolithographic technique to form a resist pattern 21 having a groove 21*a* in a predetermined position. In addition, FIG. 10(A) shows the groove 21*a* where the stubs 2*a*, 3*a* and the line 1*b* are formed in the subsequent process while a groove is simultaneously formed on a portion where the stubs 2*b*, 3*b* and the first control signal line 4 are formed.

Figure 10B:
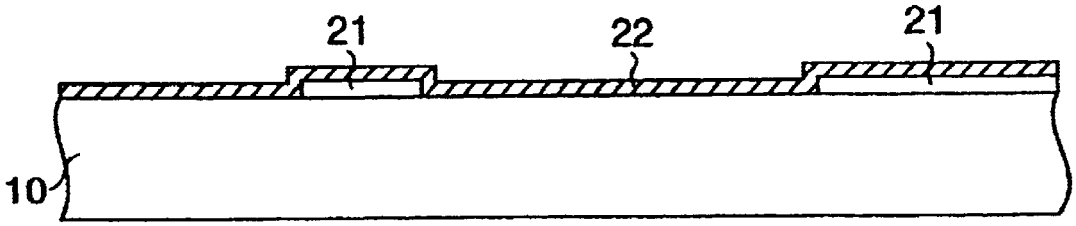
Figure 10C:
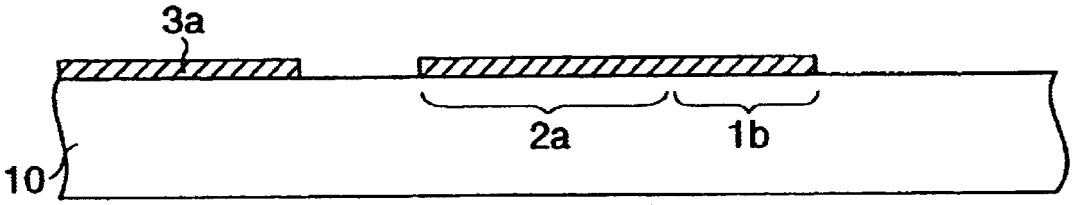

As shown in FIG. 10(B), a metal film 22 of Al is formed over the entire substrate 10 with the sputtering method. Subsequently, the metal film 22 on the resist pattern 21 is selectively removed (lifted off) by removing the resist pattern 21 so that the stubs 2*a*, 3*a* and the line 1*b* are formed on the substrate 10 as shown in FIG. 10(C). Incidentally, removal of the resist pattern 21 is carried out with a method, in which the resist pattern 21 is dissolved in an organic solvent. Although not shown, the stubs 2*b*, 3*b* and the first control signal line 4 are simultaneously formed.

Figure 1:
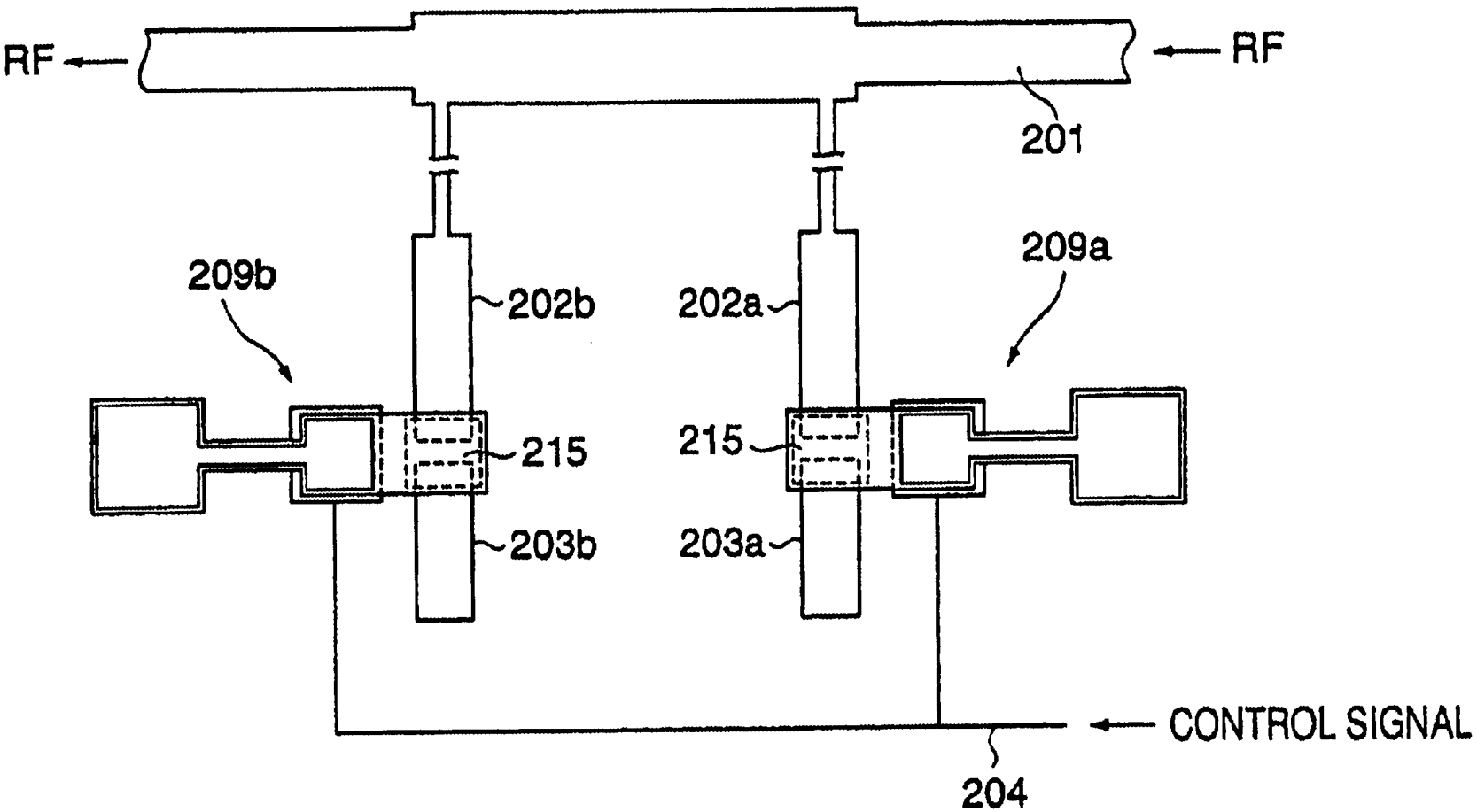
FIG. 1 PRIOR ART
FIG. 1 is a plan view showing the case where a conventional micro-machine switch is used in a well-known phase shifter.
Figure 2:
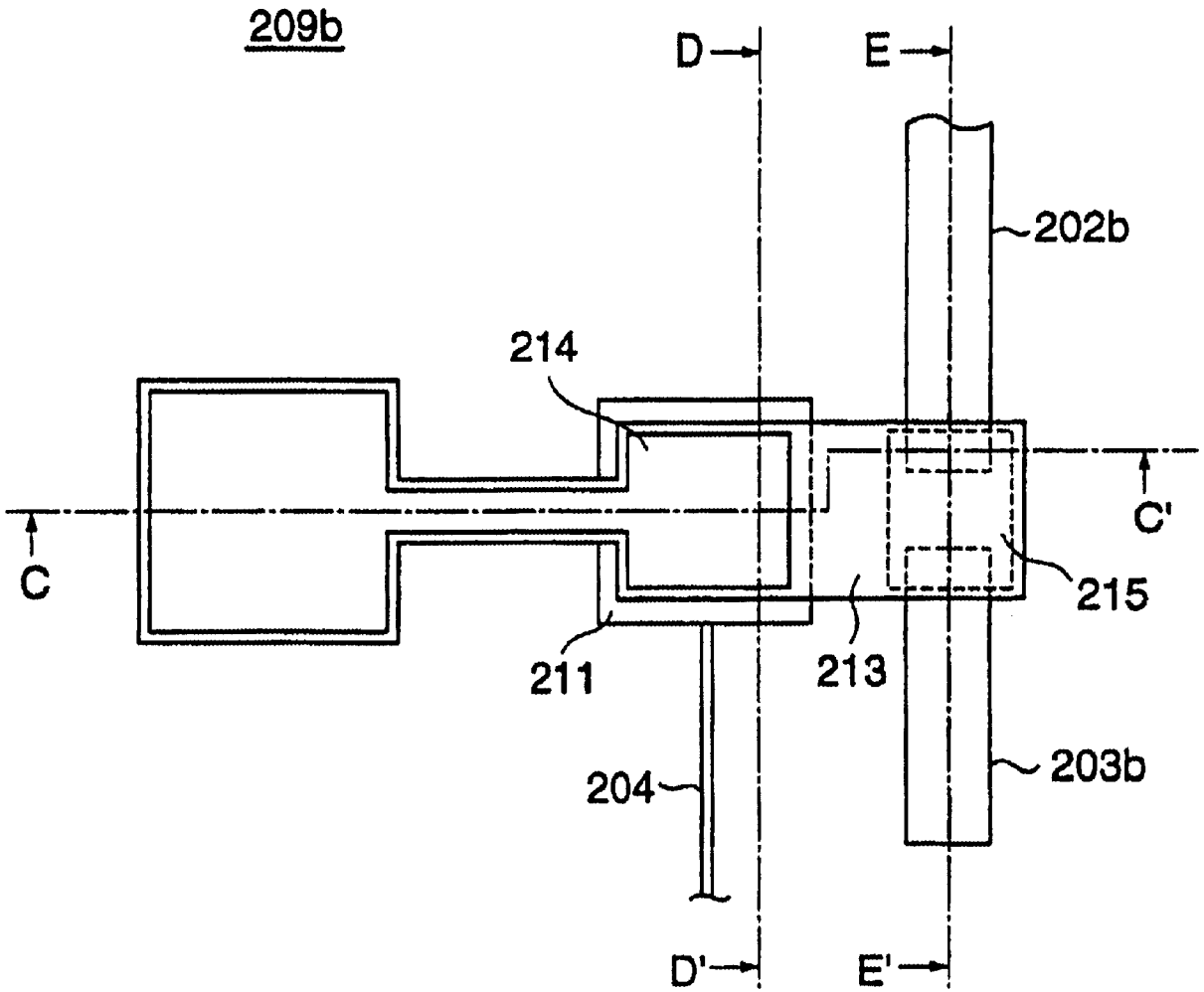
FIG. 2 PRIOR ART
FIG. 2 is a plan view shoving in enlarged scale the conventional micro-machine switch shown in FIG. 1.
Figure 3A:
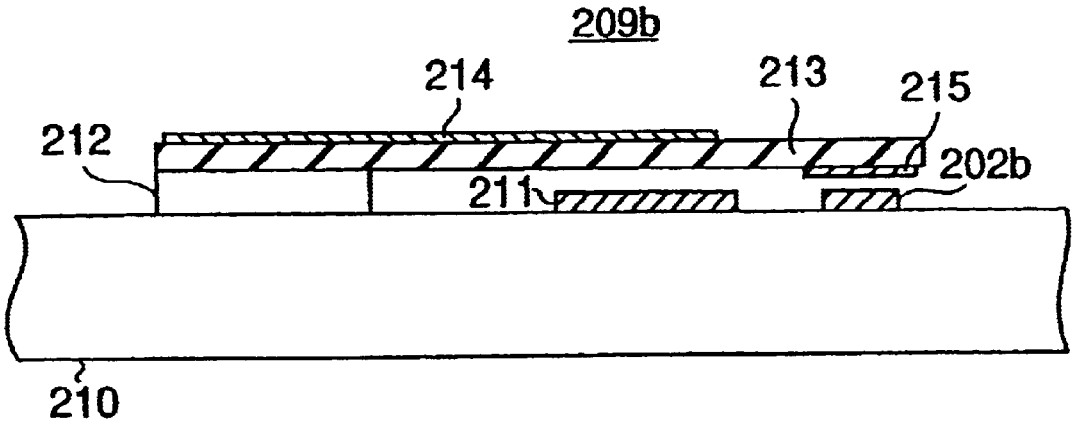
FIG. 3(A) PRIOR ART
FIGS. 3(A) to (C) are cross sectional views of the conventional micro-machine switch shown in FIG. 1.
Figure 3B:
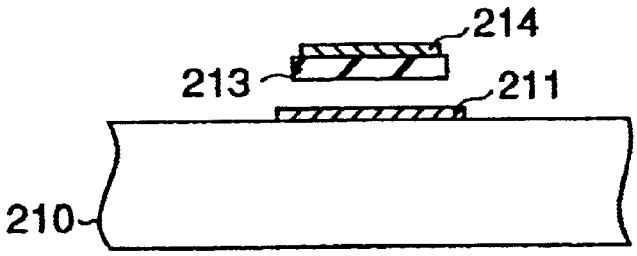
FIG. 3(B) PRIOR ART
Figure 3C:
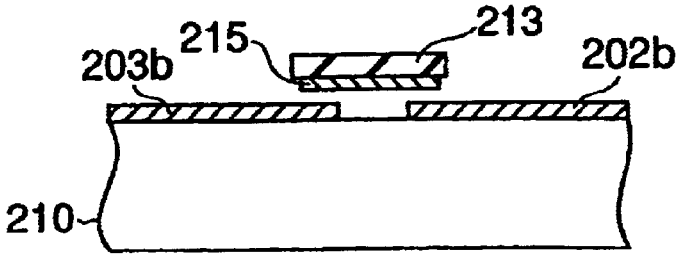
FIG. 3(C) PRIOR ART
Figure 10D:
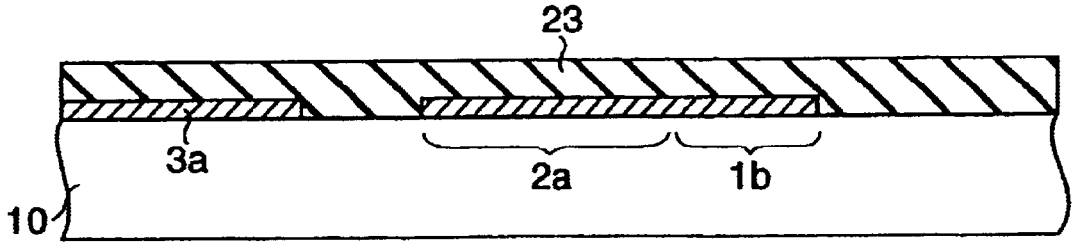
Figure 10E:
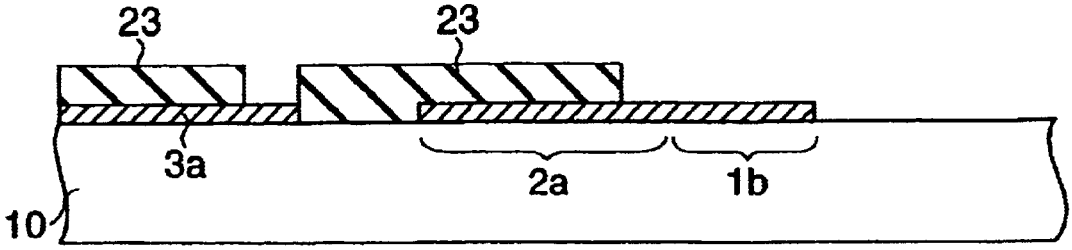

As shown in FIG. 10(D), polyimide having photosensitivity is applied and dried to form a sacrificing layer 23 having a film thickness in the order of 5 to 6 $\mu$m over the entire substrate 10. Subsequently, the known photolithographic technique is used to perform patterning on the sacrificing layer 23 as shown in FIG. 10(E). Thereby, unnecessary portions are removed while leaving the sacrificing layer 23 in a region (i.e. region where the arm 13 shown in FIG. 1 is formed) extending from a gap between the stubs 2*a*, 3*a* to a tip end of the stub 2*a* (an end toward the stub 3*a*). In addition, the sacrificing layer 23 is left in an area except an end of the stub 3*a* in FIG. 10(E). Also, although not shown, patterning is similarly performed on the sacrificing layer on a side of the stubs 2*b*, 3*b*. Subsequently, heating treatment is performed at 200 to 300° C. to cure the sacrificing layer 23 as left.

Figure 11A:
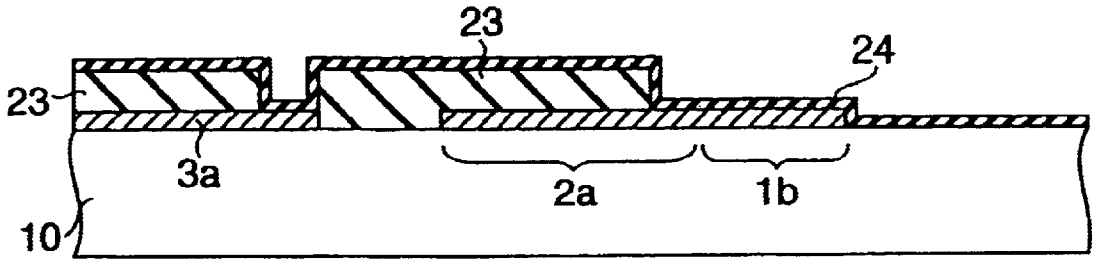
FIGS. 11(A) to 11(D) are cross sectional views illustrating processes subsequent to FIG. 10(E)
Figure 11B:
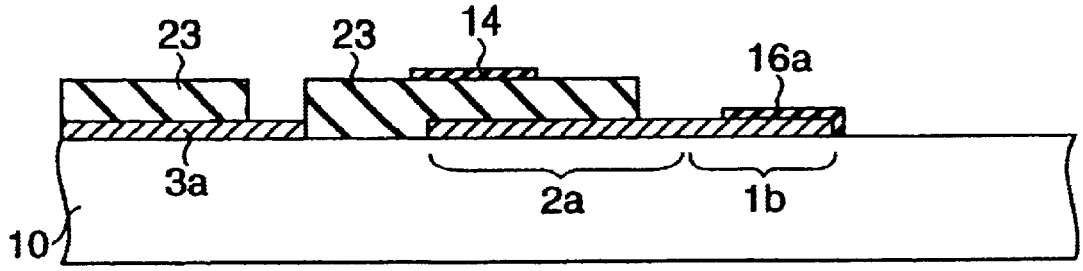

As shown in FIG. 11(A), $SiO_2$ is deposited over the entire substrate 10 with a method, such as a CVD method or a sputtering method, to form an insulating film 24 having a film thickness in the order of 0.01 to 0.3 $\mu$m. Subsequently, the known photolithographic technique and etching technique are used to remove the insulating film 24 leaving predetermined portions thereof. In this manner, as shown in FIG. 11(B), an insulating film 14 (first insulating film) is formed on a portion of the sacrificing layer 23 opposed to the tip end of the stub 2*a*, and an insulating film 16*a* (second insulating film) is formed on an end of the line 1*b*, which defines a connection between it and the stub 2*a*. Although not shown, an insulating film 14 (first insulating film) and an insulating film 16*b* (second insulating film) are similarly formed on the side of the stubs 2*b*, 3*b*. In addition, photoresist as used is removed with an alkali solvent.

Figure 11C:
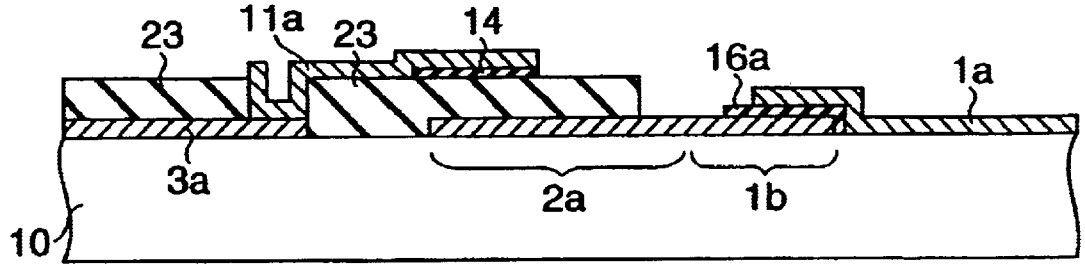

As shown in FIG. 11(C), the cantilever 11*a* made of Al is formed in an area extending an end of the stub 3*a* to the insulating film 14 on the sacrificing layer 23, and at the same time the line 1*a* made of Al is formed on the substrate 10 to extend from the insulating film 16*a*. Formation of these parts is carried out with the use of a lift-off method. Also, although not shown, the cantilever 11*b* and the line 1*c* are also at the same time formed likewise.

Figure 11D:
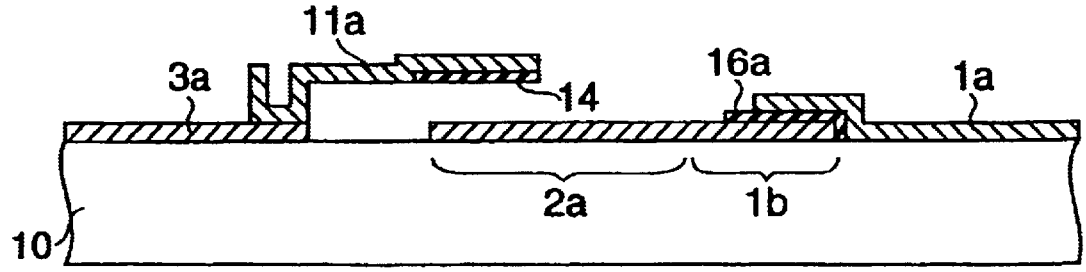

Finally, the phase shifter is finished by selectively removing only the sacrificing layer 23 as shown in FIG. 11(D) with a dry etching method, in which plasma of oxygen gas is used.

In the above description, a method, in which the post 12 and the arm 13, which constitute the cantilevers 11*a*, 11*b*, are formed in the same process, but the post 12 and the arm 13 may be formed in separate processes.

Here, the phase shifter shown in FIG. 4 and the conventional phase shifter shown in FIG. 1 are compared with each other, centering around the constitution of a micro-machine switch. First, the cantilevers 11*a*, 11*b* of the micro-machine switch shown in FIG. 4 unite the function as a movable contact and the function as a support for the movable contact. Accordingly, the cantilevers 11*a*, 11*b* correspond to the contact 215, the arm 213 and the post 212 of the micro-machine switch shown in FIG. 1 in terms of function, and the former can be formed to be small as compared with the latter and is simpler than the latter.

Also, while the cantilevers 11*a*, 11*b* are constituted by the post 12 and the arm 13, formation of the cantilevers 11*a*, 11*b* is very easy since the post 12 and the arm 13 can be formed in the same process as shown in FIG. 11(C).

Also, with the micro-machine switch shown in FIG. 4, the control signal S is applied to the line 1*b* of the main line 1 to control actions of the cantilevers 11*a*, 11*b*. Therefore, the lower electrode 211 and the upper electrode 214, which are required in the phase shifter shown in FIG. 1, are made unnecessary. In this regard, the micro-machine switch according to the present invention can be made small in size and simple in construction.

Meanwhile, with the micro-machine switch shown in FIG. 4, the insulating films 14, 16*a*, 16*b* are required for maintaining voltage value of the control signal S. However, in the case where conventional micro-machine switches are of capacitive coupling type, it is necessary to form an insulating film on an underside of the contact 215. Also, as shown in FIGS. 11(B) and 11(C), the insulating films 16*a*, 16*b* can be formed in the same process as the insulating film 14 is, and also the lines 1*a*, 1*c*, which constitute other part of the main line 1, can be formed in the same process as the cantilevers 11*a*, 11*b* are, so that the manufacturing process is not made complex.

As described above, it is possible according to the present invention to make a micro-machine switch small-sized and to simplify the switch simple in construction. Therefore, a phase shifter can be made as a whole small-sized as compared with the prior art and formed in less processes by using the micro-machine switch as a switching element.

Second Embodiment

Figure 12:
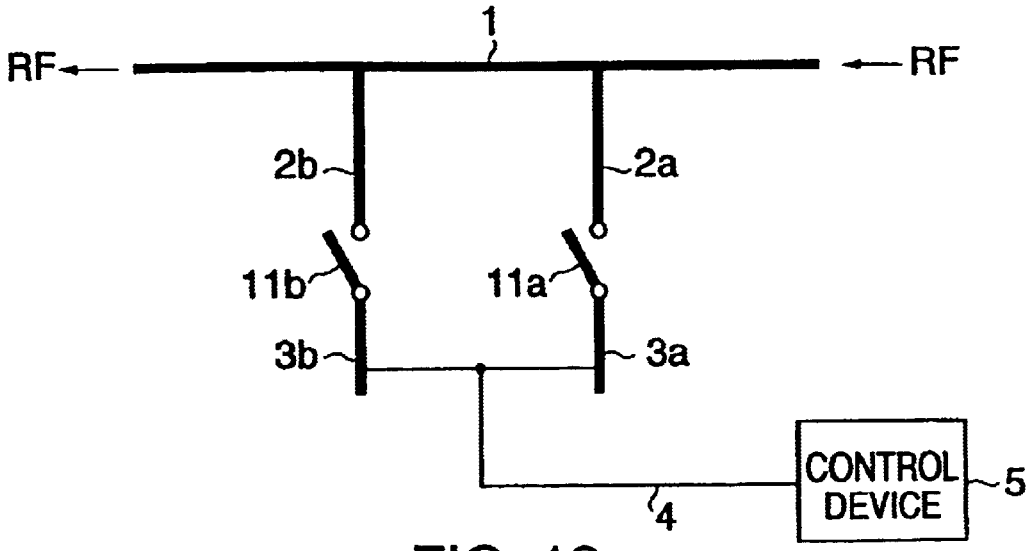
FIG. 12 is a circuit diagram showing a phase shifter according to a second embodiment of the present invention.
Figure 13:
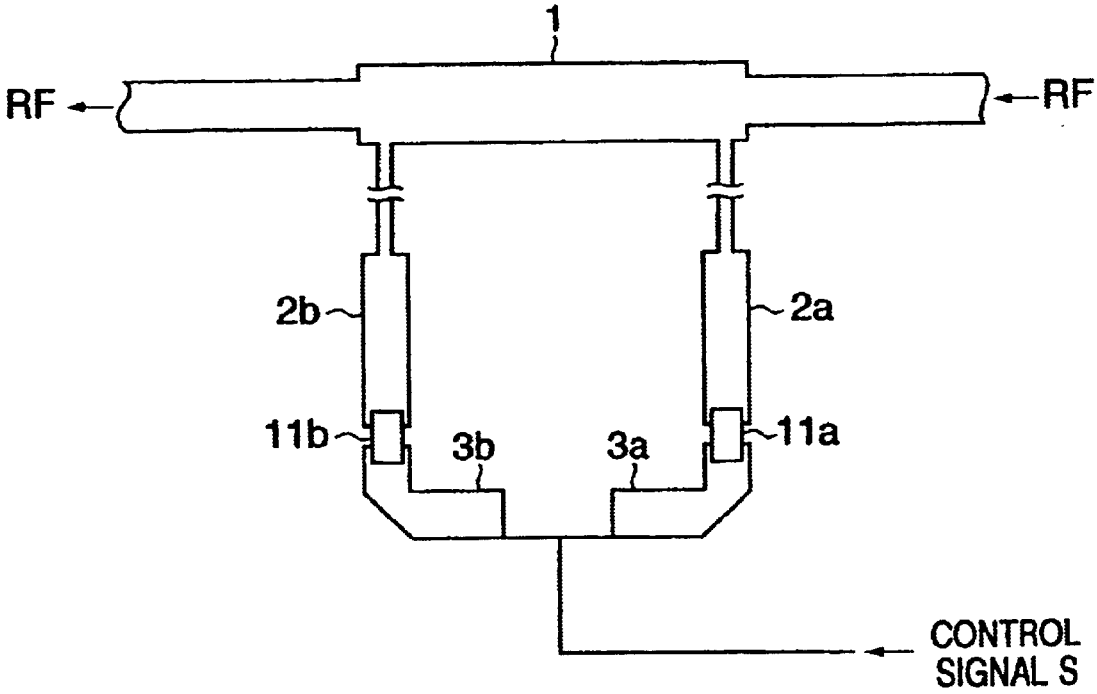
FIG. 13 is a plan view showing the phase shifter shown in FIG. 12.

FIGS. 12 and 13, respectively, are a circuit diagram and a plan view showing a phase shifter according to a second embodiment of the present invention. In FIGS. 12 and 13, the same elements as those in FIGS. 4 and 5 are designated by the same reference numerals and an explanation of the elements are suitably omitted.

The phase shifter shown in FIGS. 4 and 5 and the phase shifter shown in FIGS. 12 and 13 are different from each other in position of connection of the first control signal line 4. More specifically, the first control signal line 4 is connected to the main line 1 in the phase shifter shown in FIGS. 4 and 5. In contrast, the first control signal line 4 is connected to the stubs 3*a* and 3*b* in the phase shifter shown in FIGS. 12 and 13.

The stubs 3*a* and 3*b* are opened at tip ends thereof and not connected to other microwave circuits. Therefore, with the phase shifter shown in FIGS. 12 and 13, the open tip ends of the stubs 3*a* and 3*b* function as a second insulation without the need of provision of the capacitors 15*a* and 15*b* shown in FIGS. 4 and 5. Accordingly, being constituted as shown in FIGS. 12 and 13, the phase shifter becomes more simple in construction.

Third Embodiment

Figure 14:
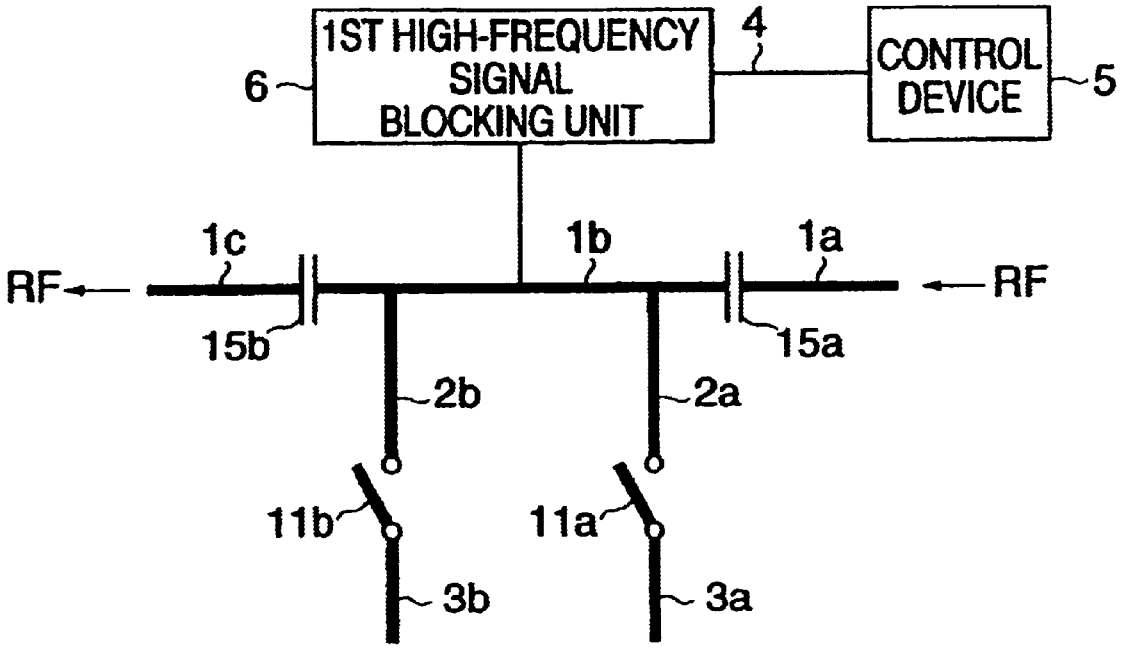
FIG. 14 is a circuit diagram showing a phase shifter according to a third embodiment of the present invention.

FIG. 14 is a circuit diagram showing a constitution of a phase shifter according to a third embodiment of the present invention. In FIG. 14, the same elements as those in FIG. 4 are designated by the same reference numerals and an explanation of the elements are suitably omitted.

The phase shifter shown in FIG. 14 is constituted by connecting a first high-frequency signal blocking unit 6 to the first control signal line 4 of the phase shifter shown in FIG. 4. The first high-frequency signal blocking unit 6 acts to block passage of the high-frequency signal RF. Accordingly, the high-frequency signal RF transmitting through the main line 1 can be prevented from flowing into the control device 5 to reduce insertion loss of the phase shifter.

Also, with the phase shifter shown in FIG. 4, there is the possibility that electricity leaking from the first control signal line 4 couples with other microwave circuits, depending upon the manner of wiring of the first control signal line 4, to adversely affect the performance of the whole circuit or make responsible for resonance. However, a circuit, in which the phase shifter is used, can be improved in high-frequency characteristics since electromagnetic coupling of the first control signal line 4 with other microwave circuits can be prevented by connecting the first high-frequency signal blocking unit 6 to the first control signal line 4.

In addition, a similar effect can be obtained by connecting the first high-frequency signal blocking unit 6 to the first control signal line 4 in the phase shifter shown in FIGS. 12 and 13.

Figure 15:
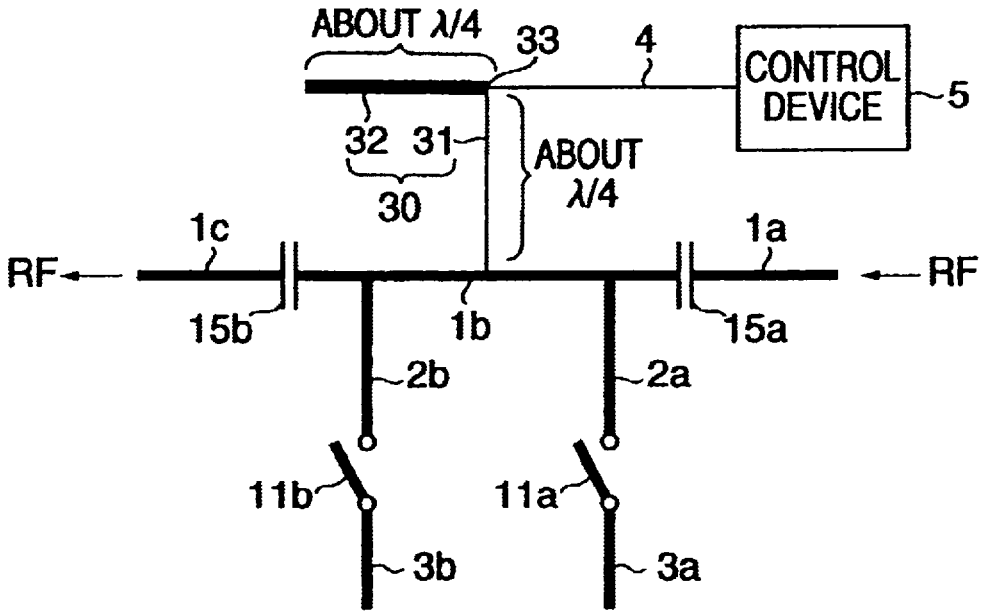
FIG. 15 is a circuit diagram showing a first constituent example of the first high-frequency signal blocking unit shown in FIG. 14.
Figure 16:
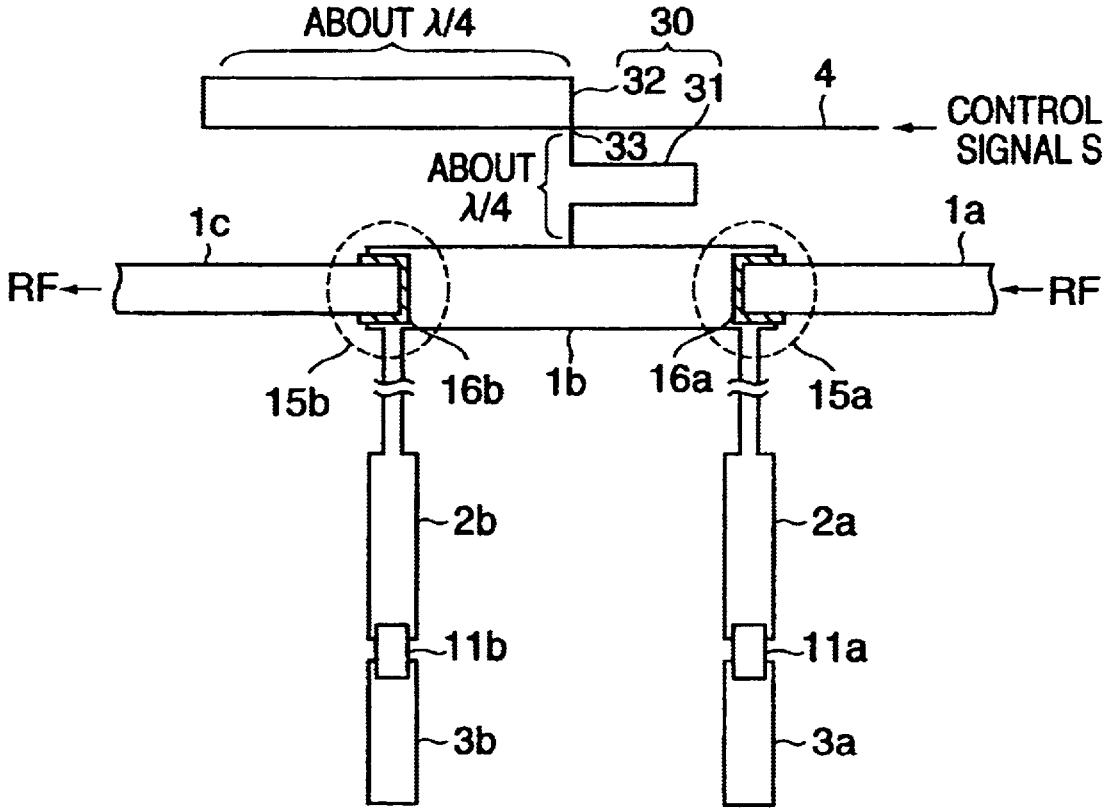
FIG. 16 is a plan view showing the first high-frequency signal blocking unit shown in FIG. 14.

Referring to FIGS. 15 to 25, an explanation will be then given to constituent examples of the first high-frequency signal blocking unit 6 in FIG. 14. First, an explanation will be given to a first constituent example of the first high-frequency signal blocking unit 6. FIGS. 15 and 16, respectively, are a circuit diagram and a plan view showing the first constituent example. The first constituent example of the first high-frequency signal blocking unit 6 is a filter 30 composed of a high-impedance λ/4 line 31 and a low-impedance λ/4 line 32. The high-impedance λ/4 line 31 has an electric length of about λ/4 (λ is a wavelength of the high-frequency signal RF) and a greater characteristics impedance than that of the main line 1. Also, the low-impedance λ/4 line 32 has an electric length of about λ/4 and a less characteristics impedance than that of the high-impedance λ/4 line 31.

It is desired that values of the characteristics impedances of these lines 31, 32 are such that when, for example, the main line 1 has generally a characteristic impedance of 50Ω, the high-impedance λ/4 line 31 has a characteristic impedance of about 70 to 200Ω and the low-impedance λ/4 line 32 has a characteristic impedance of about 20 to 40Ω.

The high-impedance λ/4 line 31 is connected at one end thereof to the line 1*b*, which is a part of the main line 1, and at the other end thereof to an end of the low-impedance λ/4 line 32. The low-impedance λ/4 line 32 is opened at the other end thereof. Further, connected to the other end (i.e. a connection 33 of the lines 31 and 32) of the high-impedance λ/4 line 31 is the first control signal line 4 of high-impedance. Accordingly, the first control signal line 4 is connected electrically to the line 1*b* via the high-impedance λ/4 line 31.

An explanation will be given below to a principle of operation of the filter 30. As described above, the low-impedance λ/4 line 32 is opened at the other end thereof. Therefore, impedance on a side of the low-impedance λ/4 line 32 as viewed from the connection 33 spaced λ/4 from such other end amounts to 0Ω, which means in a state equivalent to high-frequency grounding at the connection 33. Accordingly, even when the first control signal line 4 is connected in parallel to the connection 33, impedance at the connection 33 remains 0Ω to have no influence on the behavior of high frequency.

Further, since the line 1*b* is connected from the connection 33 via the high-impedance λ/4 line 32 having an electric length of λ/4, impedance on a side of the filter 30 from the line 1*b* becomes infinite (∞Ω). Accordingly, high-frequency wave does not flow to the side of the filter 30 from the line 1*b*, so that it leads to a state, in which the filter 30 and the first control signal line 4 are not present in terms of high frequency. The constitution of the filter 30 described herein is generally called a bias tee, and blocks only a particular frequency band to act as a kind of band blocking filter.

Figure 17:
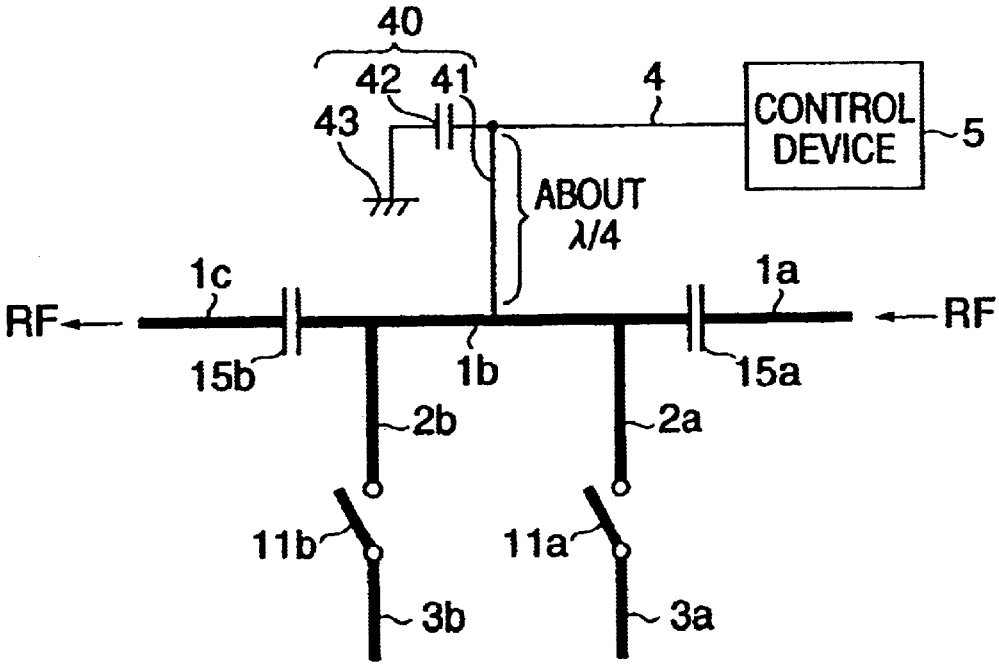
FIG. 17 is a circuit diagram showing a second constituent example of the first high-frequency signal blocking unit.
Figure 18:
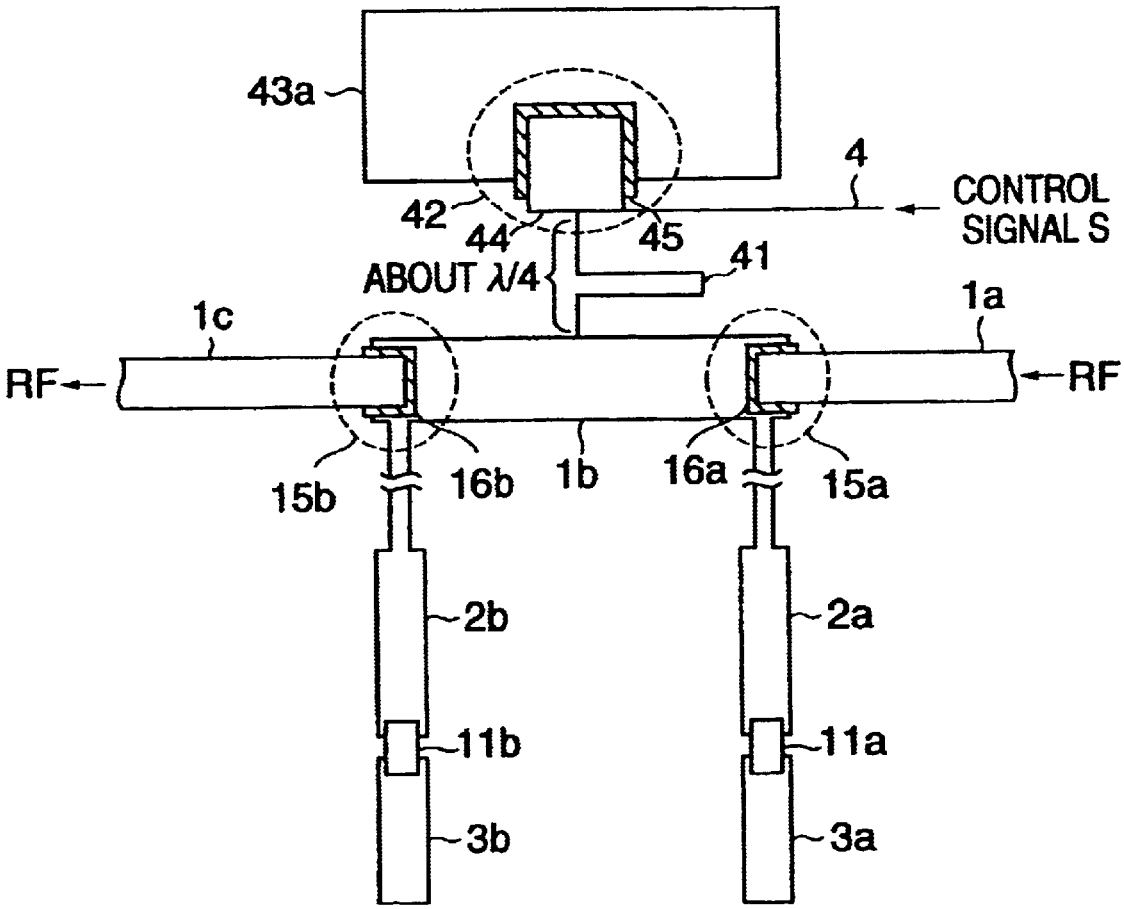
FIG. 18 is a plan view showing the first high-frequency signal blocking unit shown in FIG. 17.

An explanation will be then given to a second constituent example of the first high-frequency signal blocking unit 6. FIGS. 17 and 18, respectively, are a circuit diagram and a plan view showing the second constituent example. The second constituent example of the first high-frequency signal blocking unit 6 is a filter 40 composed of a high-impedance λ/4 line 41, a capacitor 42, and a grounding 43.

As shown in FIG. 17, the high-impedance λ/4 line 41 is connected at one end thereof to the line 1*b*, which is a part of the main line 1, and at the other end thereof to one of electrodes of the capacitor 42. Also, the other of the electrodes of the capacitor 42 is connected to the grounding 43. Further, the first control signal line 4 is connected to the one of the electrodes of the capacitor 42, to which the high-impedance λ/4 line 41 is connected. Accordingly, the first control signal line 4 is connected electrically to the line 1*b* via the high-impedance λ/4 line 41.

As shown in FIG. 18, the capacitor 42 can be composed of an electrode 44, which makes the above-mentioned the one of the electrodes, an electrode 43*a*, which makes the other of the electrodes and is grounded, and an insulating film 45 interposed between the electrodes 44, 43*a*. The high-impedance λ/4 line 41 has a high characteristic impedance and an electric length of about λ/4 (λ is a wavelength of the high-frequency signal RF). A value of the characteristic impedance of the high-impedance λ/4 line 41 is determined in the same manner as that of the high-impedance λ/4 line 31 in FIGS. 15 and 16.

An explanation will be given below to a principle of operation of the filter 40. Since the capacitor 42 has an adequate capacitance, a connection of the high-impedance λ/4 line 41 and the capacitor 42 is put in a state equivalent to high-frequency grounding, and so impedance makes 0Ω. Accordingly, like the case shown in FIGS. 15 and 16, even when the first control signal line 4 is further connected to the connection, there is no influence in terms of high frequency. Further, since the line 1*b* is connected from the capacitor 42 via the high-impedance λ/4 line 41 having an electric length of λ/4, impedance on a side of the filter 40 from the line 1*b* becomes infinite (∞Ω), that is, the high-frequency signal RF does not flow to the side of the filter 40 from the line 1*b*.

The filter 40 described herein is a kind of bias tee, and acts as a band blocking filter.

Figure 19:
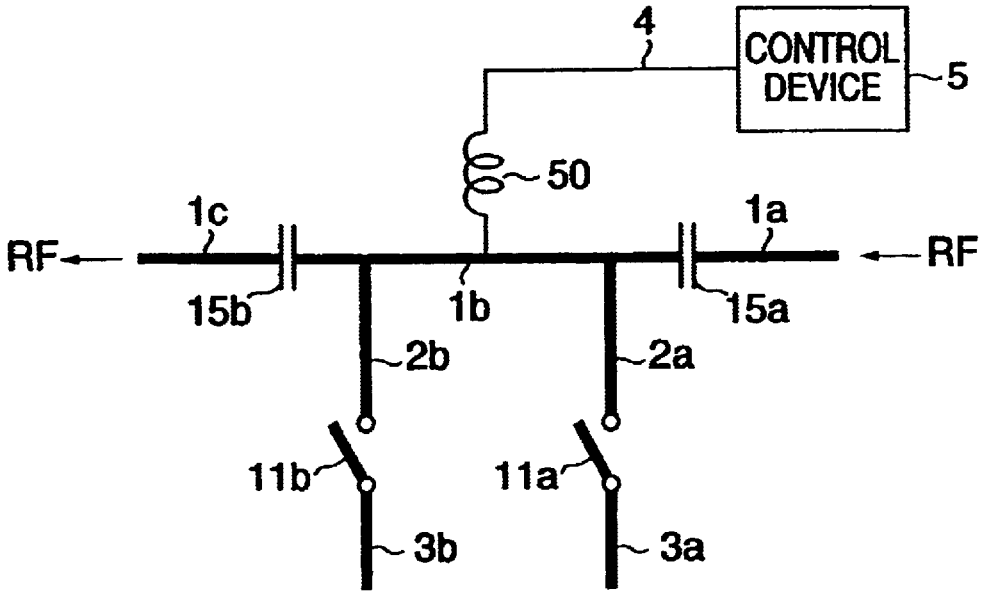
FIG. 19 is a circuit diagram showing a third constituent example of the first high-frequency signal blocking unit.
Figure 20:
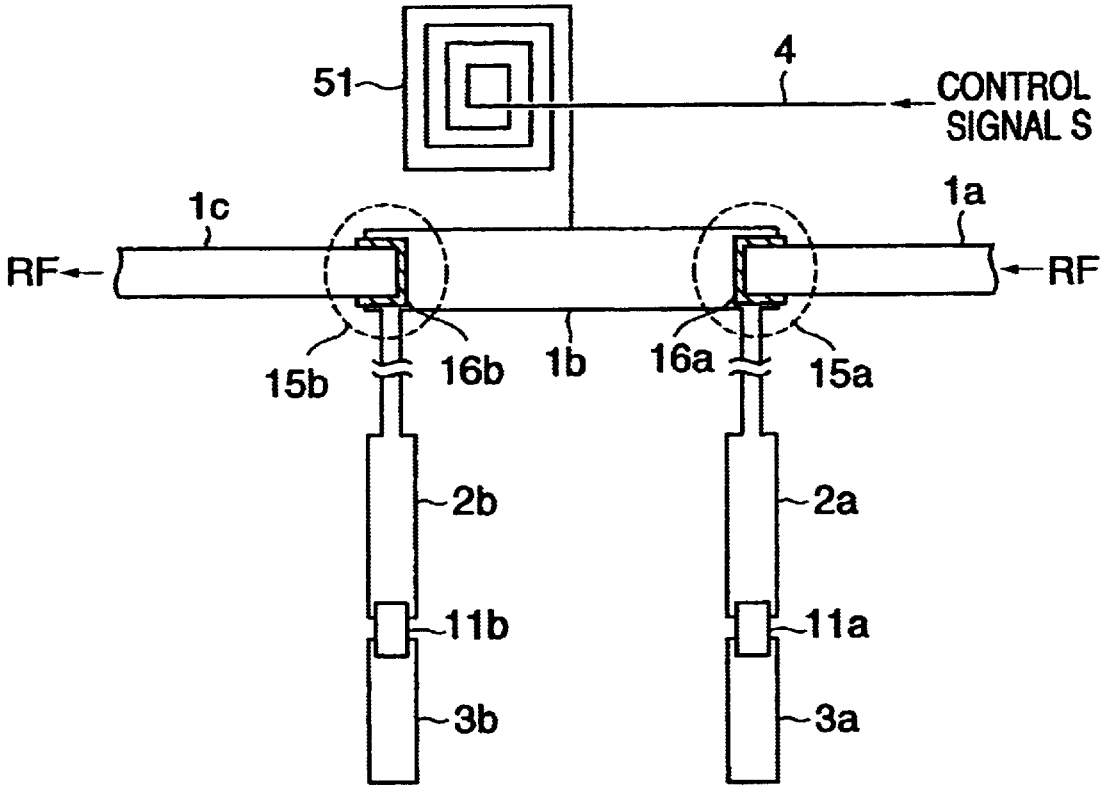
FIG. 20 is a plan view showing a concrete example of the first high frequency signal blocking unit shown in FIG. 19.
Figure 21:
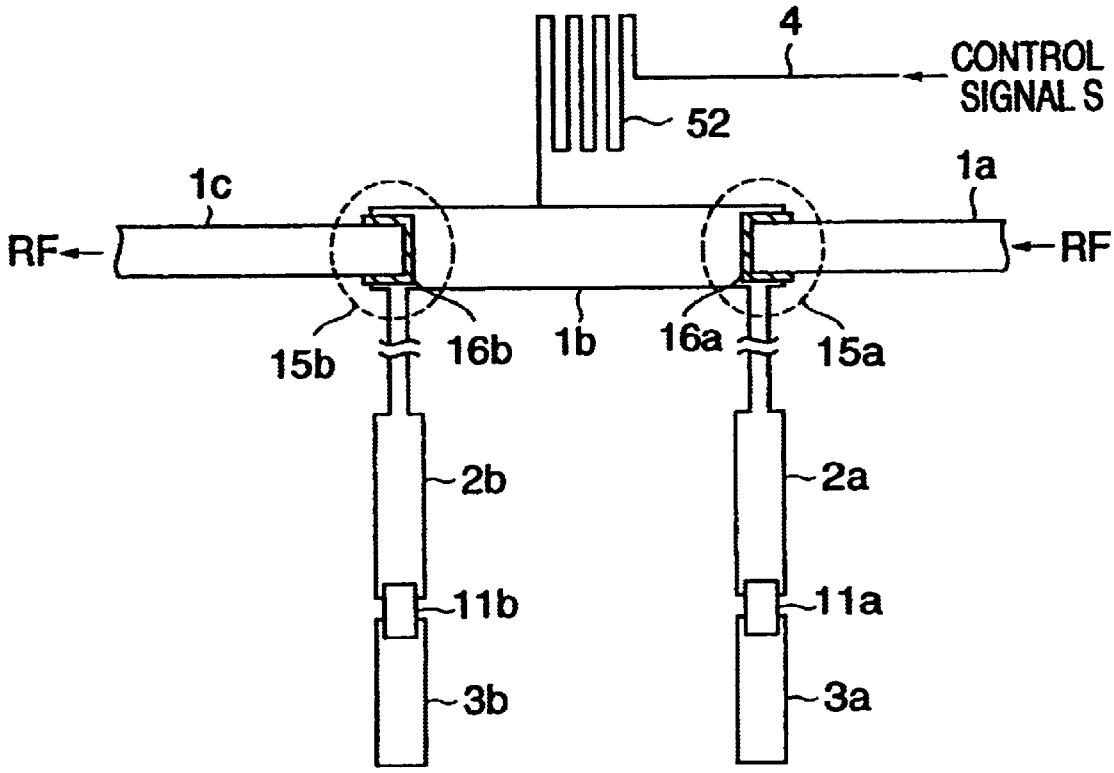
FIG. 21 is a plan view showing another concrete example of the first high-frequency signal blocking unit shown in FIG. 19.

An explanation will be then given to a third constituent example of the first high-frequency signal blocking unit 6. FIG. 19 is a circuit diagram illustrating the third constituent example. Also, FIGS. 20 and 21 are plan views showing a concrete example of the third constituent example.

The third constituent example of the first high-frequency signal blocking unit 6 is a filter 50 composed of an inductance element. It is possible to use, for example, a spiral inductor 51 shown in FIG. 20 or an underline inductor 52 shown in FIG. 21, for the filter 50.

Since these inductive circuit elements exhibit low impedance at DC to low frequency and a high impedance at high frequency, they act as a low-pass filter. However, cut-off frequency is set to be lower than the frequency of the high-frequency signal RF. In place of these distributed constant elements, lumped constant elements such as coils may be used in exterior connection. In addition, other types of filters such as filters, which are composed by cascade-connecting lines having different characteristic impedance in multi-stage, can be used as low-pass filters.

Figure 22:
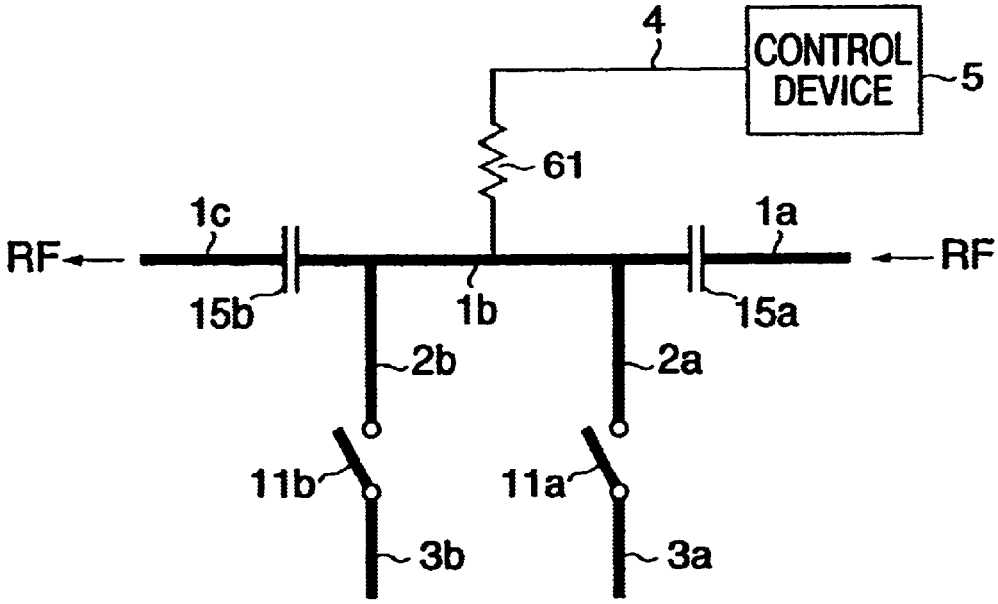
FIG. 22 is a circuit diagram showing a fourth constituent example of the first high-frequency signal blocking unit.
Figure 23:
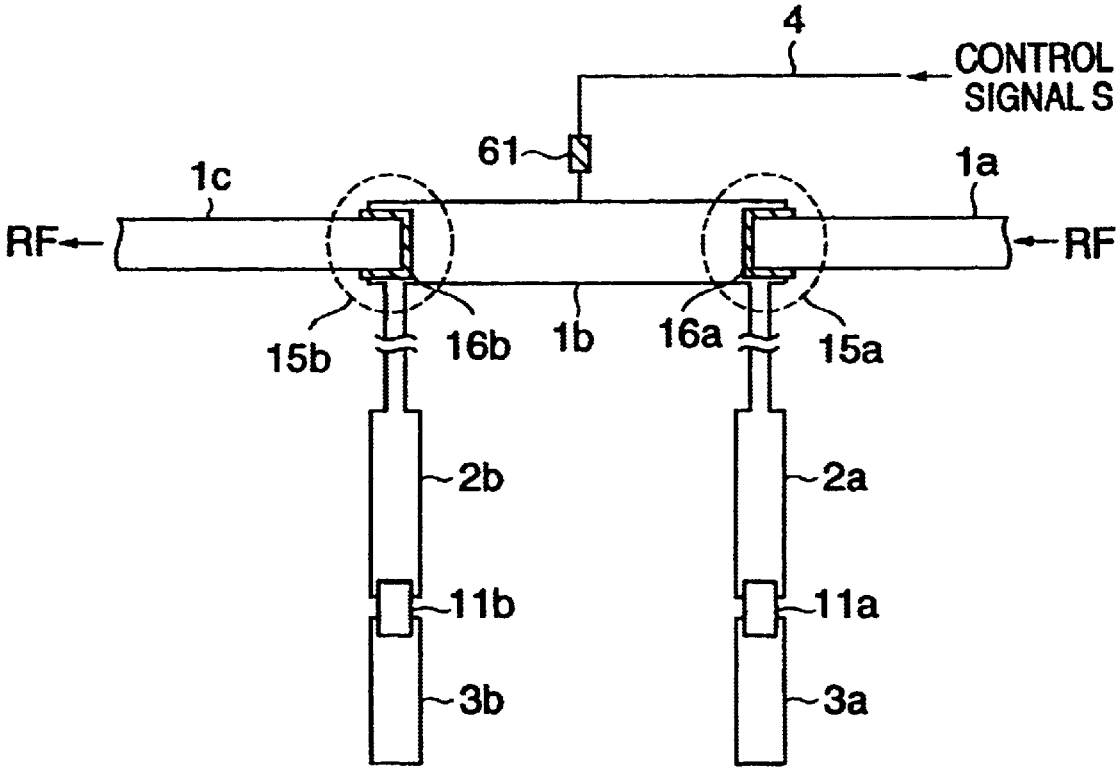
FIG. 23 is a plan view showing the first high-frequency signal blocking unit shown in FIG. 22.

An explanation will be then given to a fourth constituent example of the first high-frequency signal blocking unit 6. FIGS. 22 and 23, respectively, are a circuit diagram and a plan view showing the fourth constituent example. As shown in FIG. 22, as the first high-frequency signal blocking unit 6, a resistor element 61 is incorporated in series into the first control signal line 4 to enable blocking inflowing of the high-frequency signal RF. While a value of impedance of the resistor element 61 suffices to be equal to or more than two times as the characteristic impedance of the main line 1, it is desirably set to substantially at least twenty times as the latter. More specifically, if the main line 1 has generally a characteristic impedance of 50Ω, impedance of the resistor element 61 is determined to be substantially equal to or more than 1 kΩ. In this manner, with impedance of the resistor element 61 being determined, impedance on the side of the first control signal line 4 from the main line 1 becomes large, so that leak of the high-frequency signal RF to the first control signal line 4 can be suppressed.

For formation of the resistor element 61, a method of forming thin film resistor elements with, for example, a vacuum deposition method or the sputtering method, and a method of utilizing semiconductor n layer or n+ layer can be made use of.

To prevent leak of the high-frequency signal RF to the first control signal line 4, addition of the filters 30, 40, 50 shown in FIGS. 15 to 21 makes the whole size of the micro-machine switch increase, but the resistor element 61 shown in FIGS. 22 and 23 is made use of to attain the above-mentioned purpose without an increase in the whole size.

Figure 24:
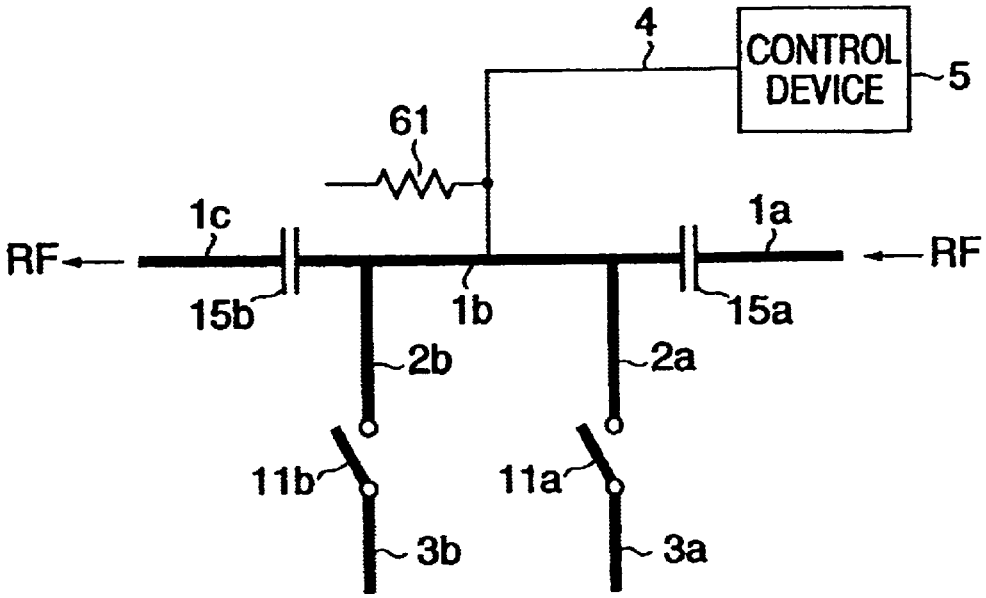
FIG. 24 is a circuit diagram showing a modified configuration of the first high-frequency signal blocking unit shown in FIG. 22.
Figure 25:
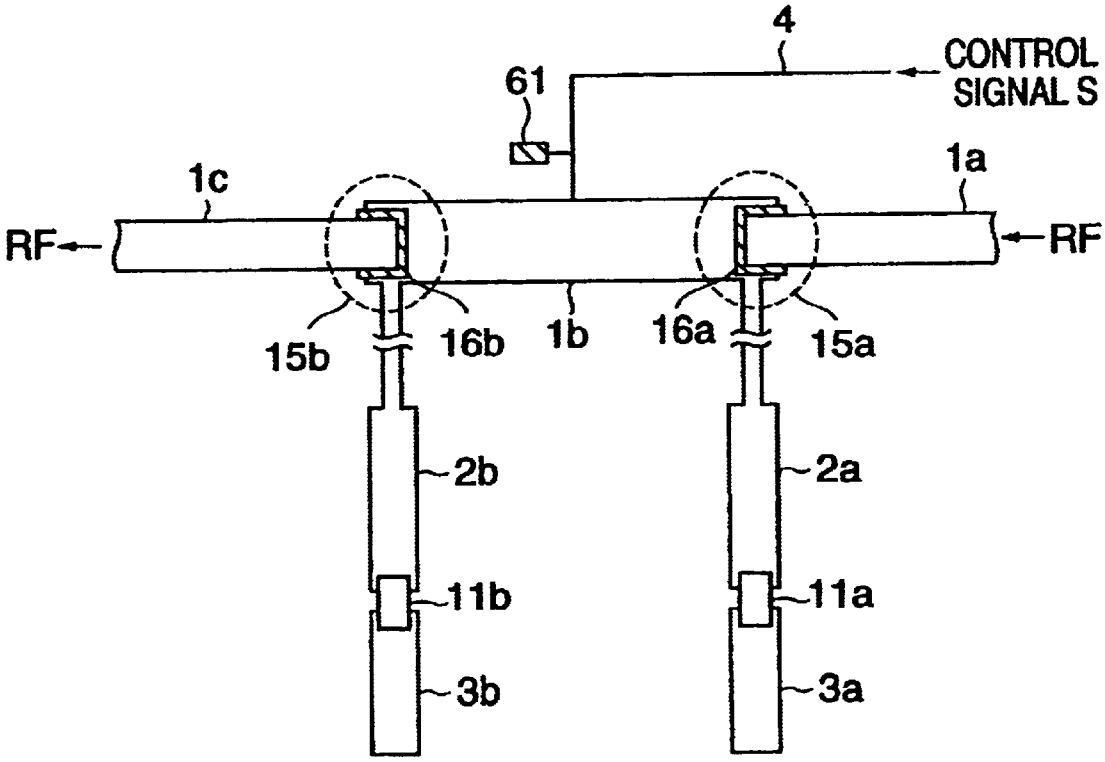
FIG. 25 is a plan view showing the first high-frequency signal blocking unit shown in FIG. 24.

In addition, as shown in FIGS. 24 and 25, parallel connection of the resistor element 61 to the first control signal line 4 (that is, one end of the resistor element 61 is connected to the first control signal line 4 and the other end thereof is opened) is also effective in prevention of generation of resonance.

Fourth Embodiment

Figure 26:
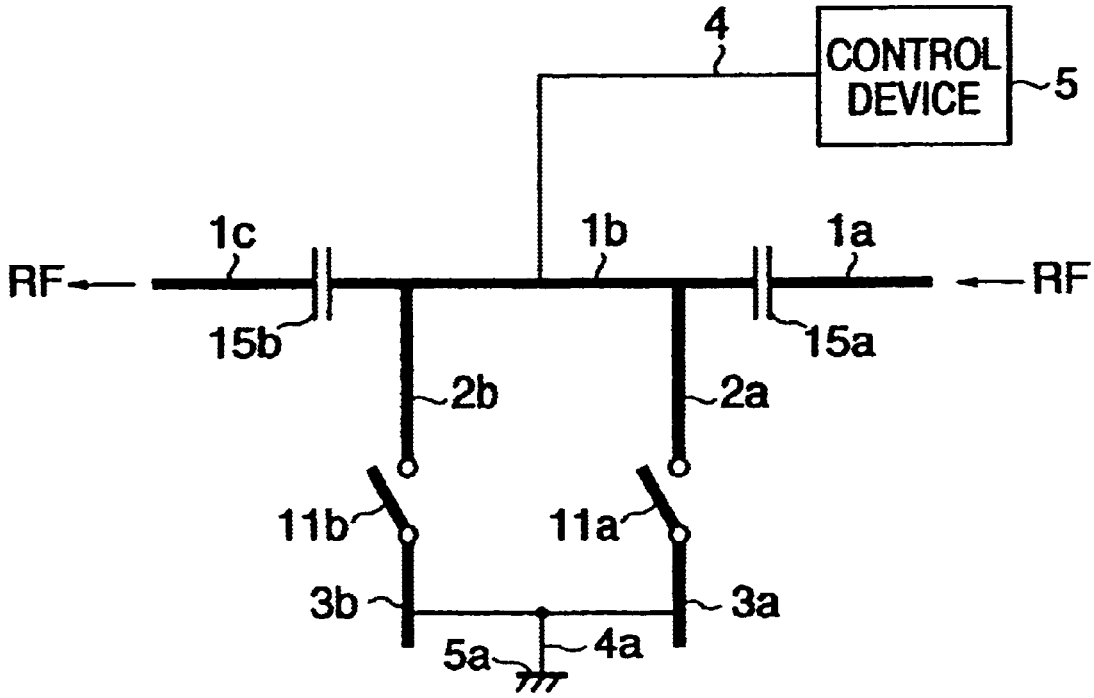
FIG. 26 is a circuit diagram showing a constitution of a phase shifter according to a fourth embodiment of the present invention.
Figure 27:
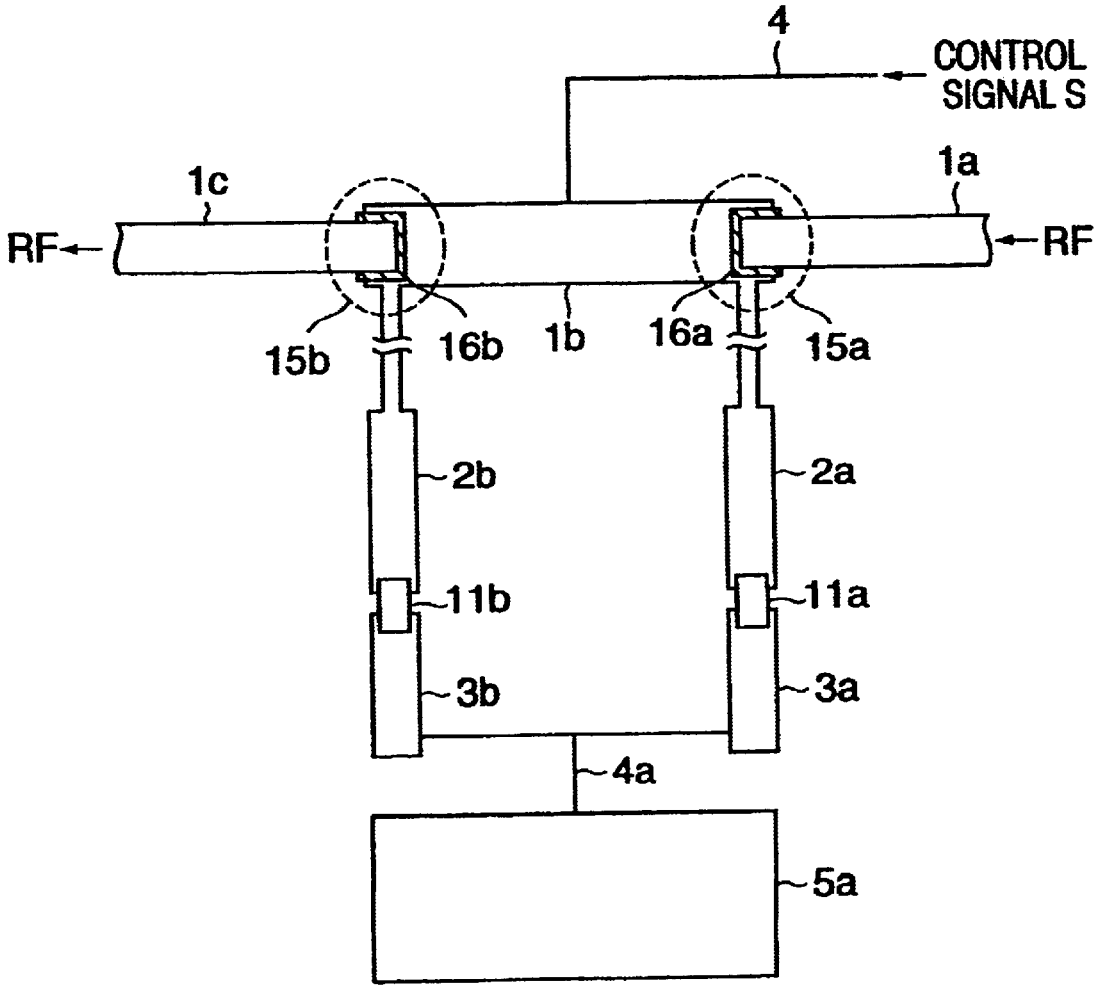
FIG. 27 is a plan view showing the phase shifter shown in FIG. 26.
Figure 28:
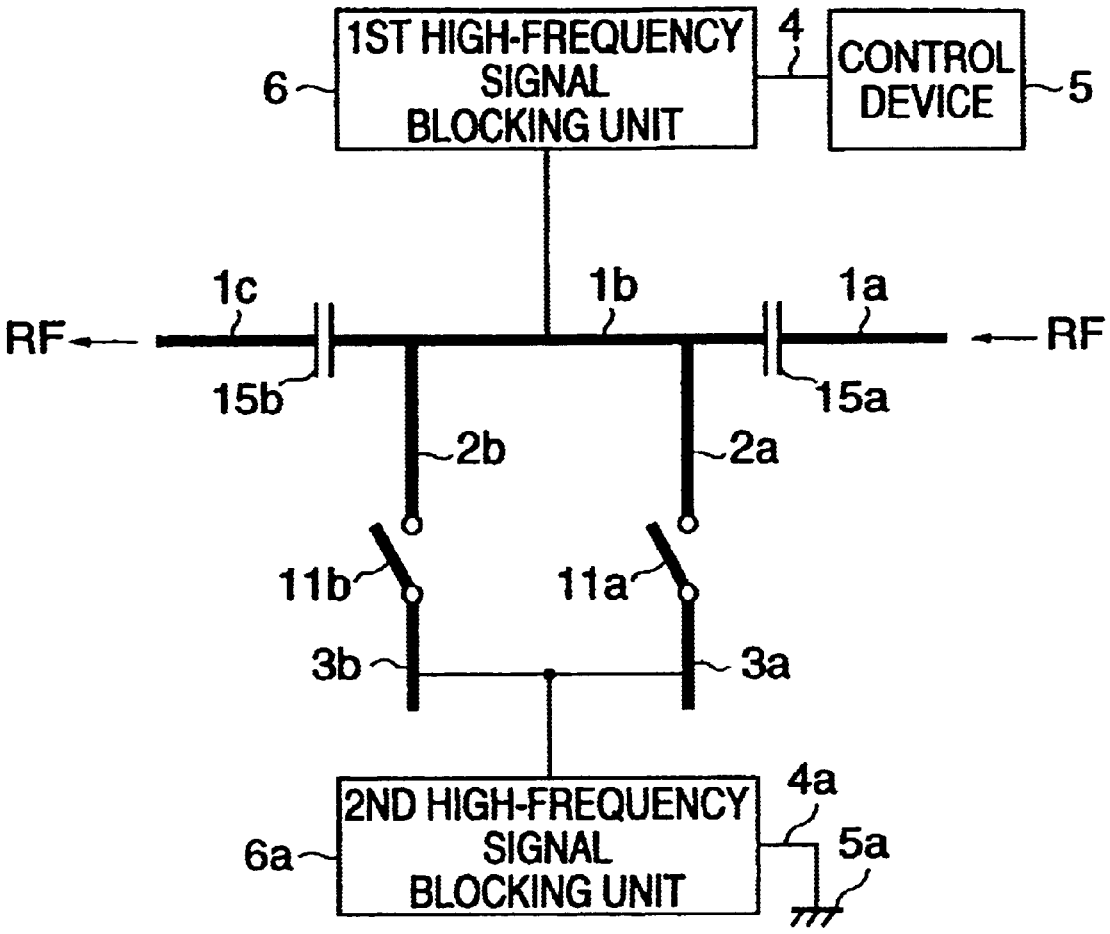
FIG. 28 is a circuit diagram showing a constitution of a phase shifter according to a fifth embodiment of the present invention.

FIGS. 28 and 27 are views showing a constitution of a phase shifter according to a fourth embodiment of the present invention. FIG. 26 is a circuit diagram and FIG. 27 is a plan view. In these figures, the same elements as those in FIGS. 4 and 5 are designated by the same reference numerals and an explanation of the elements are suitably omitted.

The phase shifter shown in FIG. 26 is constituted by connecting the cantilevers 11*a*, 11*b* of the phase shifter shown in FIG. 4 to a grounding 5*a* via the stubs 3*a*, 3*b* and a fourth control signal line 4*a*. In this manner the cantilevers 11*a*, 11*b* are grounded, whereby electric charges generated by electrostatic induction can be rapidly charged into the cantilevers 11*a*, 11*b* when application of voltage to the stubs 2*a*, 2*b* is started. On the other hand, when application of voltage is stopped, the electric charges accumulated can be rapidly discharged. Accordingly, the micro-machine switch is made stable in switching action and increased in switching speed. Thereby, the phase shifter can be rapidly and surely switched over in phase-shifting amount in addition, the same effect can be also obtained when grounding 16 given with the fourth control signal line 4*a* connected to the main line 1 of the phase shifter shown in FIG. 12.

Fifth Embodiment

FIG. 28 is a circuit diagram showing a constitution of a phase shifter according to a fifth embodiment of the present invention. In FIG. 28, the same elements as those in FIGS. 14 and 26 are designated by the same reference numerals and an explanation of the elements are suitably omitted.

The phase shifter shown in FIG. 28 is constituted by connecting the first high-frequency signal blocking unit 6 to the first control signal line 4 of the phase shifter shown in FIG. 28 and connecting a the second high-frequency signal blocking unit 6*a* to the fourth control signal line 4*a*. Here, the second high-frequency signal blocking unit 6*a* acts to block passage of the high-frequency signal RF same as the first high-frequency signal blocking unit 6.

Thus since the first and second high-frequency signal blocking units 6, 6*a*, respectively, are connected to the first and fourth control signal lines 4, 4*a*, leak of the high-frequency signal RF via the first and fourth control signal lines 4, 4*a* from the main line 1 and the stubs 3*a*, 3*b* can be prevented. Thereby, it becomes possible to reduce insertion loss of and improve the high-frequency characteristics of the phase shifter. The filters 30, 40, 50 and the resistor element 61 can be used for the first high-frequency signal blocking 6 as the second high-frequency signal blocking unit 6*a*.

Figure 29:
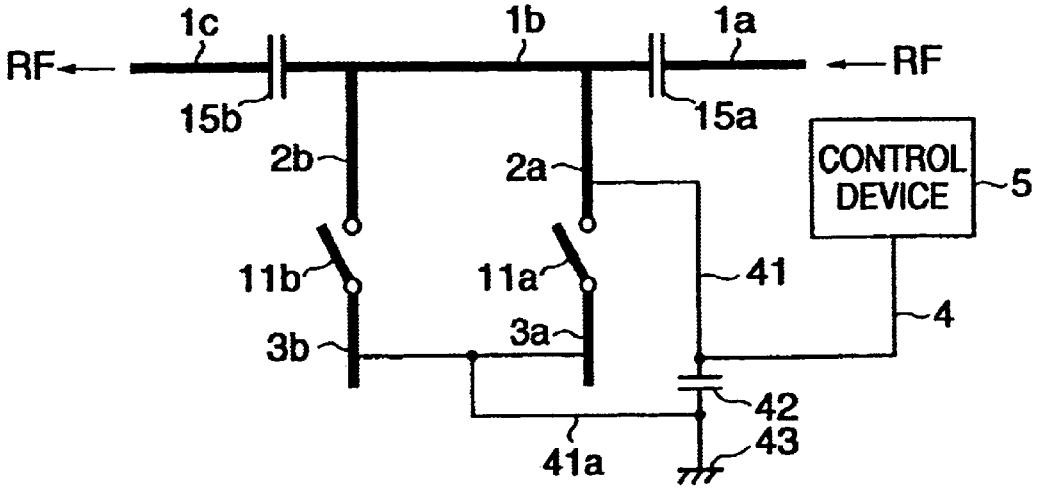
FIG. 29 is a circuit diagram showing a constitution of a phase shifter when both the first and second high-frequency signal blocking units are constituted in the same manner as a filter 40 is.
Figure 30:
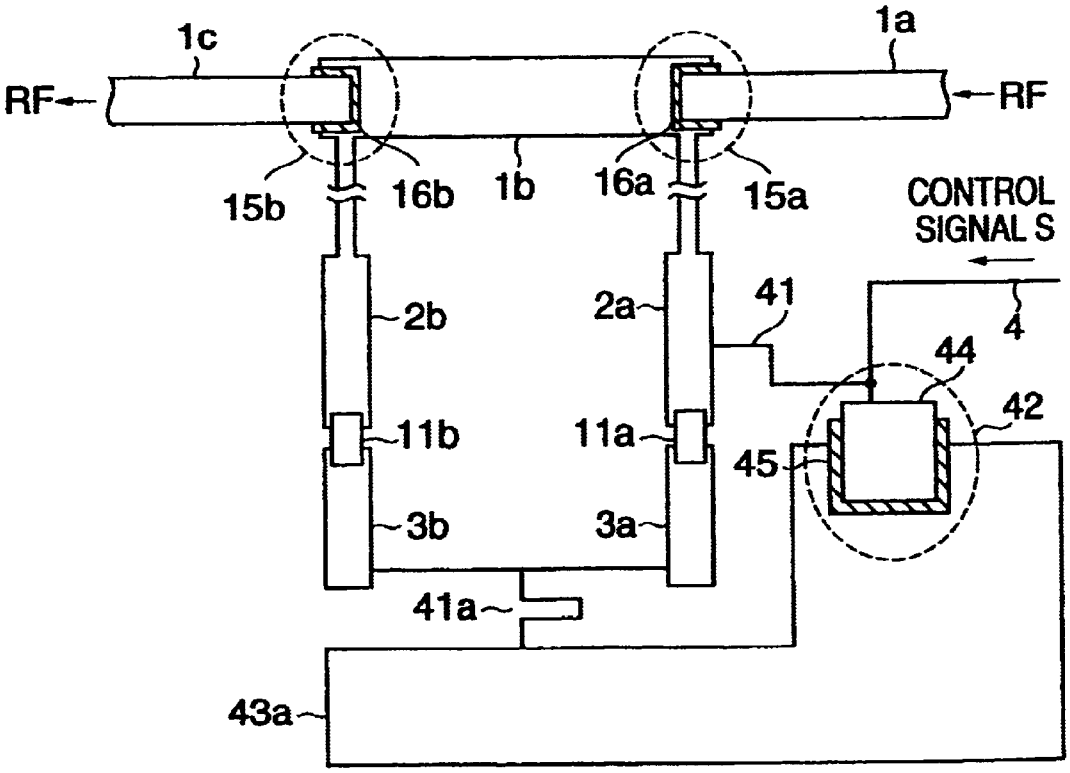
FIG. 30 is a plan view showing the phase shifter shown in FIG. 29.

In particular, when both the first and second high-frequency signal blocking units 6, 6*a* are constructed in the same manner as the filter 40, they can be made simple in construction. FIGS. 29 and 30 are views showing a constitution of a phase shifter when the first and second high-frequency signal blocking units 6, 6*a* are constructed in the same manner as the filter 40, FIG. 29 being a circuit diagram, and FIG. 30 being a plan view.

As shown in FIG. 30, the phase shifter can be constructed only by connecting the stubs 3*a*, 3*b*, shown in FIG. 18, to the earth electrode 43*a* by means of a high-impedance λ/4 line 41*a*. Here, the high-impedance λ/4 line 41*a* has the same construction as the high-impedance λ/4 line 41, in which the stub 2*a* is connected to the electrode 44. However, the phase shifter is designed so that the high-impedance λ/4 line 41*a* is constructed to have two branches in FIG. 30. In this case, an electric length between a connection to the earth electrode 43*a* and a connection to the stub 3*a* becomes λ/4, and an electric length between a connection to the earth electrode 43*a* and a connection to the stub 3*b* becomes λ/4.

In FIG. 29, the first high-frequency signal blocking unit 6 is composed of the high-impedance λ/4 line (first high-impedance line) 41, the capacitor 42, and the grounding 43. Also, the second high-frequency signal blocking unit 6*a* is constituted by connecting the high-impedance λ/4 line (the second high-impedance line) 41*a* to the grounding 43. In this manner, the phase shifter can be made small in size as a whole because the micro-machine switch can be made small in size by sharing constituent parts between the first and second high-frequency signal blocking units 6, 6*a*. In addition, the first and second high-frequency signal blocking units 6, 6*a* may be constructed in the same or different manner.

Sixth Embodiment

Figure 31:
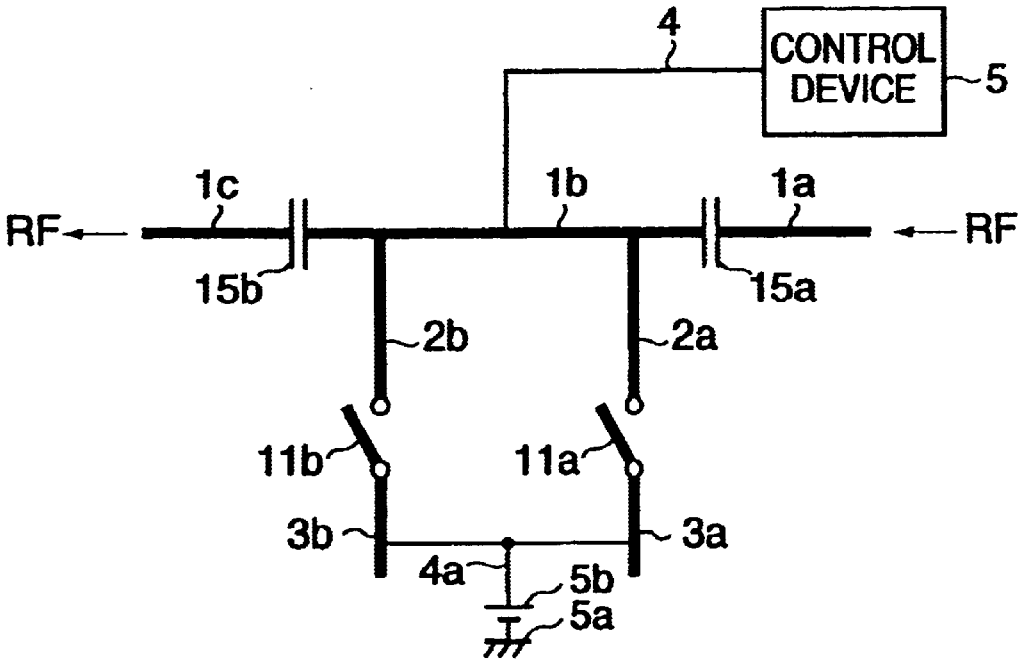
FIG. 31 is a circuit diagram showing a constitution of a phase shifter according to a sixth embodiment of the present invention.

FIG. 31 is a circuit diagram showing a constitution of a phase shifter according to a sixth embodiment of the present invention. In FIG. 31, the same elements as those in FIG. 4 are designated by the same reference numerals and an explanation of the elements are suitably omitted. The phase shifter shown in FIG. 31 is constructed such that the constant-voltage power source 5*b* is connected through a fourth control signal line 4*a* to the stubs 3*a*, 3*b* shown in FIG. 4.

Output voltage of the constant-voltage power source 5*b* is of reverse polarity to that of the control signal S outputted from the control device 5. More specifically, if the control signal S is composed of ON/OFF of positive voltage, the constant-voltage power source 5*b* outputs negative constant voltage. However, because the cantilevers 11*a*, 11*b* must act on the basis of the control signal S, the output voltage of the constant-voltage power source 5*b* is set to one in such a degree that only it does not cause the cantilevers 11*a*, 11*b* to act. For the cantilevers 11*a*, 11*b* designed to be actuated by the control signal S of 40 V in FIG. 4, output voltage of the constant-voltage power source 5*b* is set to, for example, −20V.

The cantilevers 11*a*, 11*b* are both formed at undersides thereof with the insulating film 14, and the stubs 3*a*, 3*b* are both opened at tip ends thereof. Accordingly, constant voltage applied to the stubs 3*a*, 3*b* is maintained in voltage value. In addition, the opened tip ends of the stubs 3*a*, 3*b* carry out the function of a third insulating unit described later.

In this manner, if a predetermined voltage is beforehand applied to the cantilevers 11*a*, 11*b* through the stubs 3*a*, 3*b*, the control signal S can be reduced in level of voltage. With the above-mentioned example, the cantilevers 11*a*, 11*b* can be made to act by application of ON/OFF signals of 20V to the line 1*b* as the control signal S.

When a high voltage is applied as the control signal S, surge generates and noises based on high-speed change in voltage become noticeable in some cases. However, with the micro-machine switch shown in FIG. 31, the control signal S can be made low in voltage, so that it is possible to solve such problems.

To obtain the same effect in the phase shifter shown in FIGS. 12 and 13, it is necessary to specifically provide a third insulating section for keeping a voltage value for the constant voltage, together with the insulating film 14 formed on each of the cantilevers 11*a*, 11*b*. Such third insulating section can be constituted by forming, for example, the capacitors 15*a*, 15*b* shown in FIG. 4 in the same position on the main line 1. Alternatively, a coupling condenser contained in other microwave circuits connected to the main line 1 may be used as the third insulating section.

Figure 32:
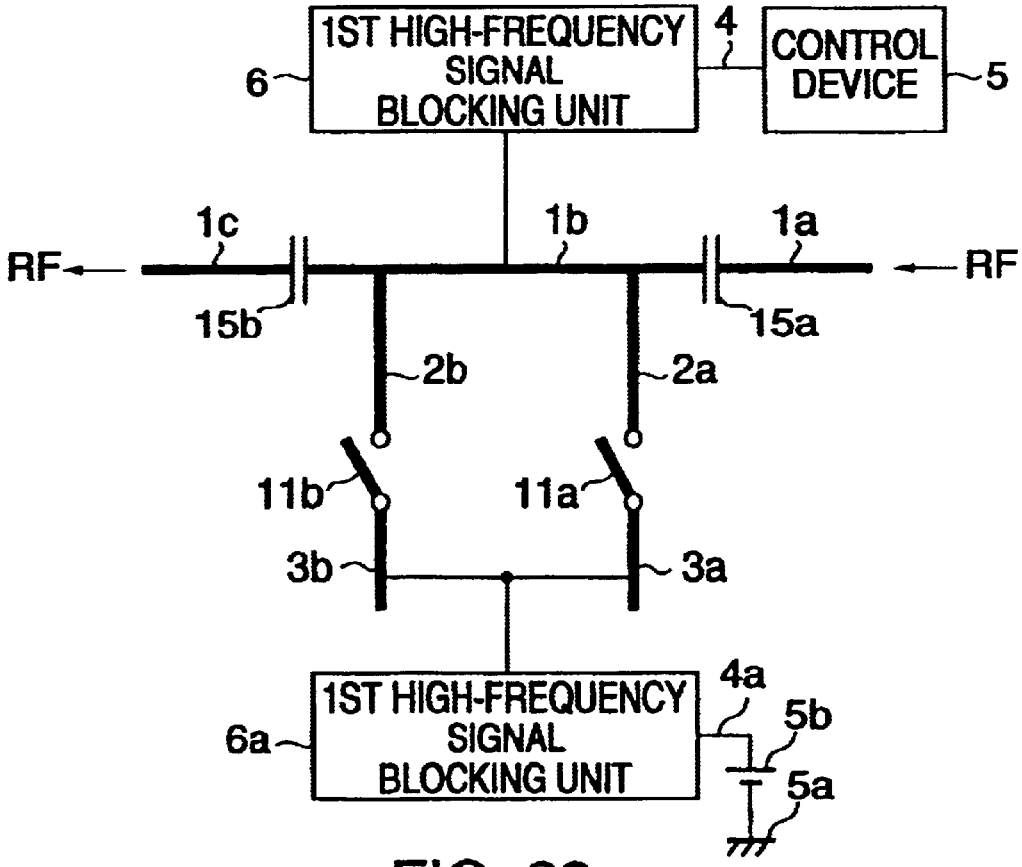
FIG. 32 is a circuit diagram showing a modified configuration of the phase shifter shown in FIG. 31.

FIG. 32 is a circuit diagram illustrating a modified configuration of the phase shifter shown in FIG. 31. With a phase shifter shown in FIG. 32, the first and second high-frequency signal blocking units 6, 6*a*, respectively, are connected to the first and fourth control signal lines 4, 4*a*. The first and second high-frequency signal blocking units 6, 6*a* act to block passage of the high-frequency signal RF, and are constituted in the same manner as the phase shifter shown in FIG. 28. Connection of the first and second high-frequency signal blocking units 6, 6*a* eliminates an increased insertion loss of the phase shifter and degradation of the high-frequency characteristics of the phase shifter.

Seventh Embodiment

Figure 33:
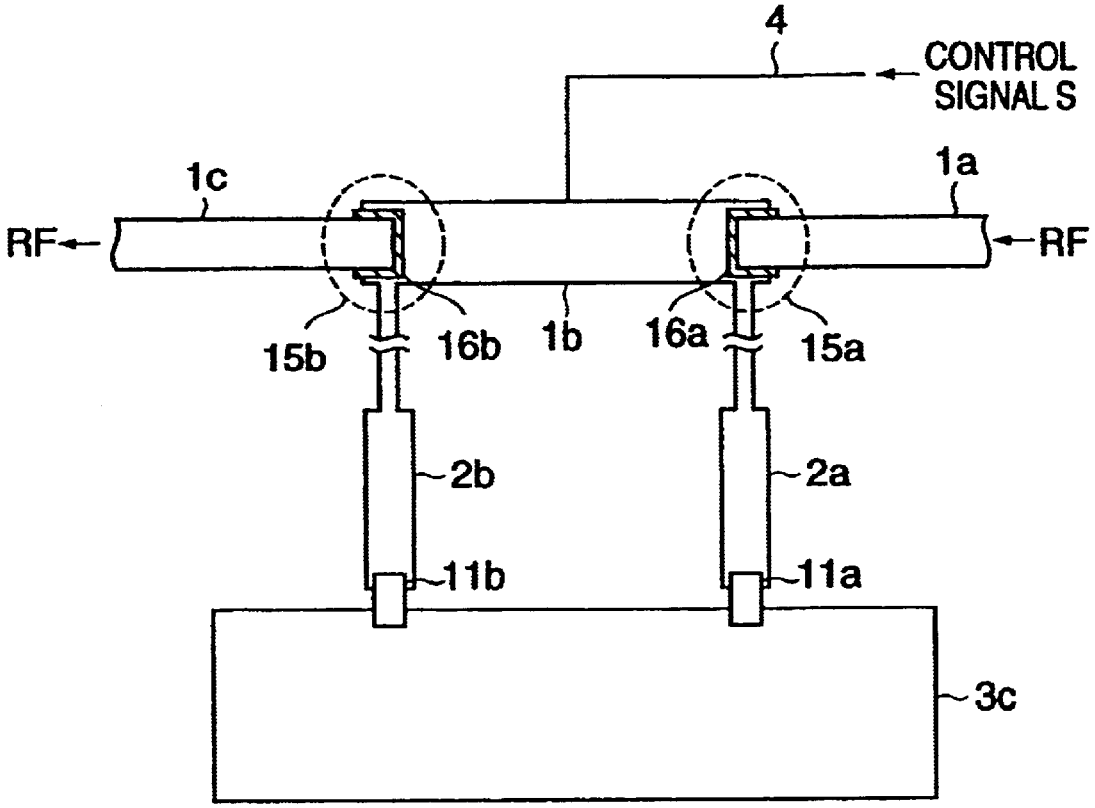
FIG. 33 is a plan view showing a constitution of a phase shifter according to a seventh embodiment of the present invention.

FIG. 33 is a plan view showing a constitution of a phase shifter according to a seventh embodiment of the present invention. In FIG. 33, the same elements as those in FIG. 4 are designated by the same reference numerals and hence an explanation of the elements are suitably omitted. The phase shifter shown in FIG. 33 is a low deadline type phase shifter different from the type of the phase shifter shown in FIG. 4. These both phase shifters are different in constitution from each other in the following point The phase shifter shown in FIG. 4 performs switching of connection/opening between the stubs 2*a*, 2*b* and the stubs 3*a*, 3*b*. In contrast, the phase shifter shown in FIG. 33 performs switching of connection/opening between the stubs 2*a*, 2*b* and an earth electrode 3*c*.

When the stubs 2*a*, 2*b* are connected to or opened from the earth electrode 3*c* in high-frequency fashion, susceptance on the side of the stubs 2*a*, 2*b* from the main line 1 changes. Accordingly, for the same reason as explained with respect to the phase shifter shown in FIG. 4, the high-frequency signal RF transmitting through the main line 1 can be switched over in phase-shifting amount by making the control signal S ON/OFF and thereby controlling high-frequency connection of the stubs 2*a*, 2*b* and the earth electrode 3*c*.

With the phase shifter shown in FIG. 33, the cantilevers 11*a*, 11*b*, respectively, may be fixedly mounted on the tip ends of the stubs 2*a*, 2*b* or on a periphery of the earth electrode 3*c* on the side of the stubs 2*a*, 2*b*. However, in the case of the former, tip ends (tip end of the arm 13) of the cantilevers 11*a*, 11*b* are made to freely come toward and away from the periphery of the earth electrode 3*c* on the side of the stubs 2*a*, 2*b*. On the other hand, in the case of the latter, the tip ends of the cantilevers 11*a*, 11*b* must freely come toward and away from the tip ends of the stubs 2*a*, 2*b*.

In addition, according to the present invention, the earth electrode 3*c* is defined as a distributed constant line having an electric potential of zero, and will be contained in the second distributed constant line. Also, the first high-frequency signal blocking unit 6 may be connected to the first control signal line 4.

Eighth Embodiment

Several embodiments have been described in the case where the present invention is applied to a low deadline type phase shifter. However, the present invention is not limited to such case but can be applied to other types of phase shifters, for example, switched-line type and reflecting type phase shifters, and the like.

Figure 34:
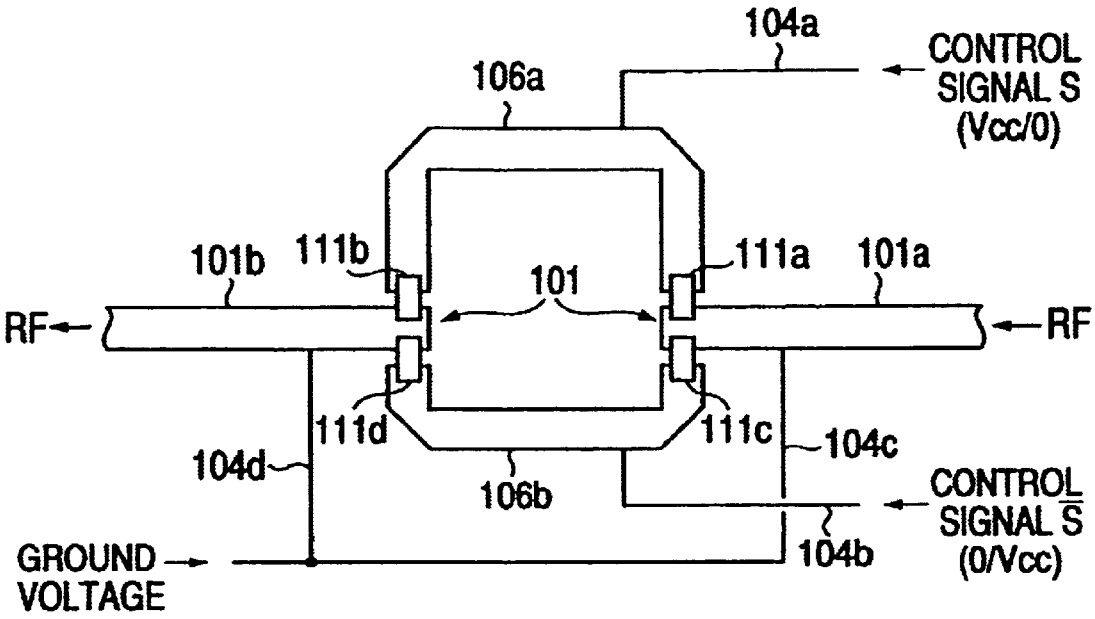
FIG. 34 is a plan view showing a constitution of a phase shifter according to an eighth embodiment of the present invention.

An explanation will be given below to an embodiment, in which the present invention is applied to the switched-line type phase shifters. FIG. 34 is a plan view showing a constituent example of a phase shifter according to an eighth embodiment of the present invention. As shown in FIG. 34, a main line (first distributed constant line) 101 includes a cut part. The main line 101 is composed of two lines 101*a*, 101*b* with the cut part therebetween. And two switching lines (second distributed constant line) 106*a*, 106*b* are arranged with slight gaps between the both lines 101*a*, 101*b* and them. Such switching lines 106*a*, 106*b* have different electric lengths from each other.

Cantilever 111*a*, 111*b*, 111*c*, 111*d*, respectively, are arranged at four gaps between the lines 101*a*, 101*b* and the switching lines 106*a*, 106*b*. More concretely, the cantilever 111*a* is arranged between the line 101*a* and the switching line 106*a*, and the cantilever 111*b* is arranged between the line 101*b* and the switching line 106*a*. Also, the cantilever 111*c* is arranged between the line 101*a* and the switching line 106*b*, and the cantilever 111*d* is arranged between the line 101*b* and the switching line 106*b*.

These cantilevers 111*a* to 111*d* have the same construction as that of the cantilever 11*a* shown in FIG. 4. The cantilevers

111*a*, 111*b*, respectively, among the cantilevers are fixedly mounted on both ends of the switching line 106*a*, and tip ends (tip end of the arm 13) of the cantilevers 111*a*, 111*b*, respectively, are made to come toward and away from respective ends of the lines 101*a*, 101*b*. However, the cantilevers 111*a*, 111*b*, respectively, may be fixedly mounted on respective ends of the lines 101*a*, 101*b*, and tip ends (tip end of the arm 13) of the cantilevers 111*a*, 111*b*, respectively, may be made to come toward and away from both ends of the switching line 106*a*. Relationships among the cantilevers 111*c*, 111*d*, the lines 101*a*, 101*b*, and the switching lines 106*a*, 106*b* are the same as that described above.

A second control signal line 104*a* is connected to the switching line 106*a* so that a control signal (second control signal) S is applied to the switching line through the second control signal line 104*a*. A third control signal line 104*b* is connected to the switching line 106*b* so that a control signal (third control signal) $\overline{S}$ is applied to the switching line via the third control signal line 104*b*. A first control signal line is composed of the second and third control signal lines 104*a*, 104*b*.

The control signals S, $\overline{S}$ are two signals to be complementary to each other, and comprise signals composed of change of voltage Vcc and 0. Here, 0 electric potential indicates a ground potential, and Vcc indicates voltage other than 0.

Meanwhile, control signal lines 104*c*, 104*d*, respectively, are connected to the lines 101*a*, 101*b*, which constitute the main line 101. A constant bias is applied to the lines 101*a*, 101*b* via such control signal lines 104*c*, 104*d*. The constant bias is desirably one (in this case, Vcc or 0) of two states of the control signals S, $\overline{S}$. In FIG. 34, ground potential is given as the constant bias.

In addition, the constant bias may not be strictly identical to one voltage of the two states of the control signals S, $\overline{S}$, but are allowable in a range, in which the cantilevers 111*a* to 111*d* surely act in accordance with change of state of the control signals S, $\overline{S}$.

Also, although not shown, insulating films, respectively, are formed as a first insulating portion on undersides of tip ends of the cantilevers 111*a* to 111*d* (or 111C, 111*d*) as in the phase shifter shown in FIG. 4. However, one of two insulating films corresponding to the two cantilevers 111*a*, 111*b* provided on the same switching line 106*a* (or 106*b*) functions as a second insulating portion. A voltage value applied to the switching lines 106*a*, 106*b*, respectively, is kept by such insulating portions.

An explanation will be then given to an operation of the phase shifter shown in FIG. 34. When the control signals S, $\overline{S}$ are not applied to the both switching lines 106*a*, 106*b* (when 0 V), the switching lines 106*a*, 106*b* are not connected to the lines 101*a*, 101*b* in high-frequency fashion since the tip ends of the cantilevers 111*a* to 111*d* are spaced away from ends of the lines 101*a*, 101*b*.

In this state, it is assumed that the voltage Vcc is applied to the switching line 106*a* via the second control signal line 104*a* and the ground potential is imparted to the switching line 106*b* via the third control signal line 104*b*. Since the lines 101*a*, 101*b* are both given the ground potential, the tip ends of the cantilevers 111*a*, 111*b*, respectively, are attracted by electrostatic forces generated between them and the ends of the lines 101*a*, 101*b* to contact with the ends of the lines 101*a*, 101*b*. Thereby, the switching line 106*a* is connected to the lines 101*a*, 101*b* in high-frequency fashion to short-circuit the cut part of the main line 101.

Meanwhile, since the switching line 106*b* is at the same electric potential as that of the lines 101*a*, 101*b*, the tip ends of the cantilevers 111*c*, 111*d* are not put in contact with the ends of the lines 101*a*, 101*b*, and so the switching lines 106*a*, 106*b* are not connected to the lines 101*a*, 101*b* in high-frequency fashion.

Subsequently, it is assumed that the ground potential is applied to the switching line 106*a* via the second control signal line 104*a* and the voltage Vcc is imparted to the switching line 106*b* via the third control signal line 104*b*. When application of the voltage Vcc to the witching line 106*a* is stopped, electrostatic forces between the tip ends of the cantilevers 111*a*, 111*b* and the ends of the lines 101*a*, 101*b* disappear. Therefore, the cantilevers 111*a*, 111*b* return to their original configurations, and so high-frequency connection between the switching line 106*a* and the lines 101*a*, 101*b* is released.

Meanwhile, the tip ends of the cantilevers 111*c*, 111*d* are attracted by electrostatic forces generated between them and the ends of the lines 101*a*, 101*b* to contact with the ends of the lines 101*a*, 101*b*. Thereby, the switching line 106*b* short-circuits, in place of the switching line 106*a*, the cut part of the main line 101 in high-frequency fashion.

In this manner, the control signals S, $\overline{S}$ are used to enable switch the switching lines 106*a*, 106*b*, which function to short-circuit the cut part of the main line 101. As described above, because the switching lines 106*a*, 106*b* have different electric lengths, an effective electric length between the lines 101*a*, 101*b* can be changed by switching the switching lines 106*a*, 106*b*, which function to short-circuit the cut part of the main line 101. Accordingly, the high-frequency signal RF transmitting through the main line 1 can be switched over in phase-shifting amount.

Figure 35:
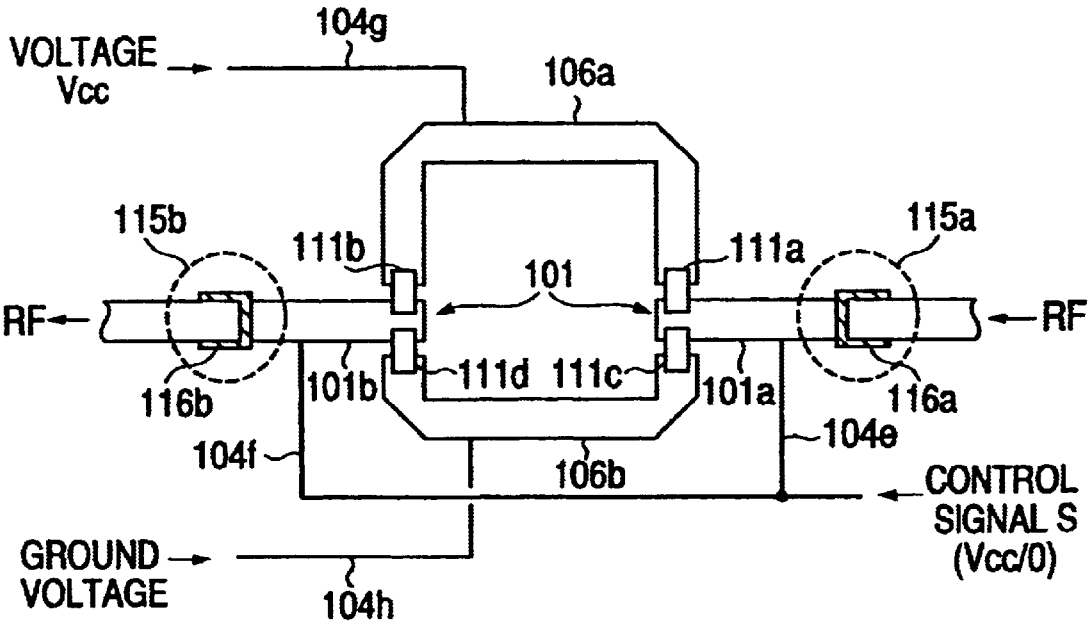
FIG. 35 is a plan view showing another constituent example of the phase shifter shown in FIG. 34.

FIG. 35 is a plan view showing another constituent example of the phase shifter according to the eighth embodiment of the present invention. With the phase shifter shown in FIG. 35, a constant bias is applied to the switching lines 106*a*, 106*b*, and the control signal S is applied to the lines 101*a*, 101*b*, which constitute the main line 101. This makes the above-mentioned phase shifter different from the phase shifter shown in FIG. 34. More specifically, as shown in FIG. 35, first control signal lines 104*e*, 104*f*, respectively, are connected to the lines 101*a*, 101*b*, and the control signal (first control signal) S is applied via the first control signal lines 104*e*, 104*f*. The control signal S is one composed of change of voltage Vcc and 0.

A control signal line 104*g* is connected to the switching line 106*a*, and the voltage Vcc is applied via the control signal line 104*g*. Also, a control signal line 104*h* is connected to the switching line 106*b*, and ground potential is given via the control signal line 104*h*.

The constant biases given to the switching lines 106*a*, 106*b* are desirably respective voltages (in this case, Vcc or 0) of two states of the control signal S. However, these constant biases suffice to be constant voltages equivalent to respective voltages value of two states of the control signal S, and are allowable in a range, in which the cantilevers 111*a* to 111*d* surely act in accordance with change of state of the control signal S.

Also, the lines 101*a*, 101*b*, which constitute the main line 101, respectively are formed with capacitors 115*a*, 115*b*. The capacitors 115*a*, 115*b* are formed in the same manner as the capacitors 15*a*, 15*b* shown in FIG. 4. These two capacitors 115*a*, 115*b* constitute a second insulating portion.

The above-mentioned first control signal lines 104*e*, 104*f*, respectively, are connected between the ends of the lines

101*a*, 101*b* and the capacitors 115*a*, 115*b*. Accordingly, voltage value of the control signal S applied via the first control signal lines 104*e*, 104*f* is kept by insulating films (not shown) provided every the capacitors 115*a*, 115*b* and the cantilevers 111*a* to 111*d*.

With the phase shifter constructed in this manner, when the voltage Vcc is applied to the lines 101*a*, 101*b* as the control signal S, the switching line 106*b* is connected to the lines 101*a*, 101*b* in high-frequency fashion. Meanwhile, when the ground potential is applied as the control signal S, the switching line 106*a* is connected to the lines 101*a*, 101*b* in high-frequency fashion. Accordingly, the high-frequency signal RF transmitting through the main line 101 can be switched over in phase-shifting amount since the switching lines 106*a*, 106*b*, which function to short-circuit the cut part of the main line 101, are switched over by the control signal S.

In addition, in the phase shifter shown in FIGS. 34 and 35, leak of the high-frequency signal RF transmitting through the main line 101 can be prevented by connecting the first high-frequency signal blocking unit 6 to the control signal lines 104*a*, 104*b*, 104*e*, 104*f* and connecting the second high-frequency signal blocking unit 6*a* to the control signal lines 104*c*, 104*d*, 104*g*, 104*h*.

Ninth Embodiment

The above-mentioned phase shifters according to the first to eighth embodiments can realize a digital phase shifter of a single bit. A digital phase shifter of two bits or more can be constituted by cascade-connecting these phase shifters having different phase-shifting amounts from each other.

Figure 36:
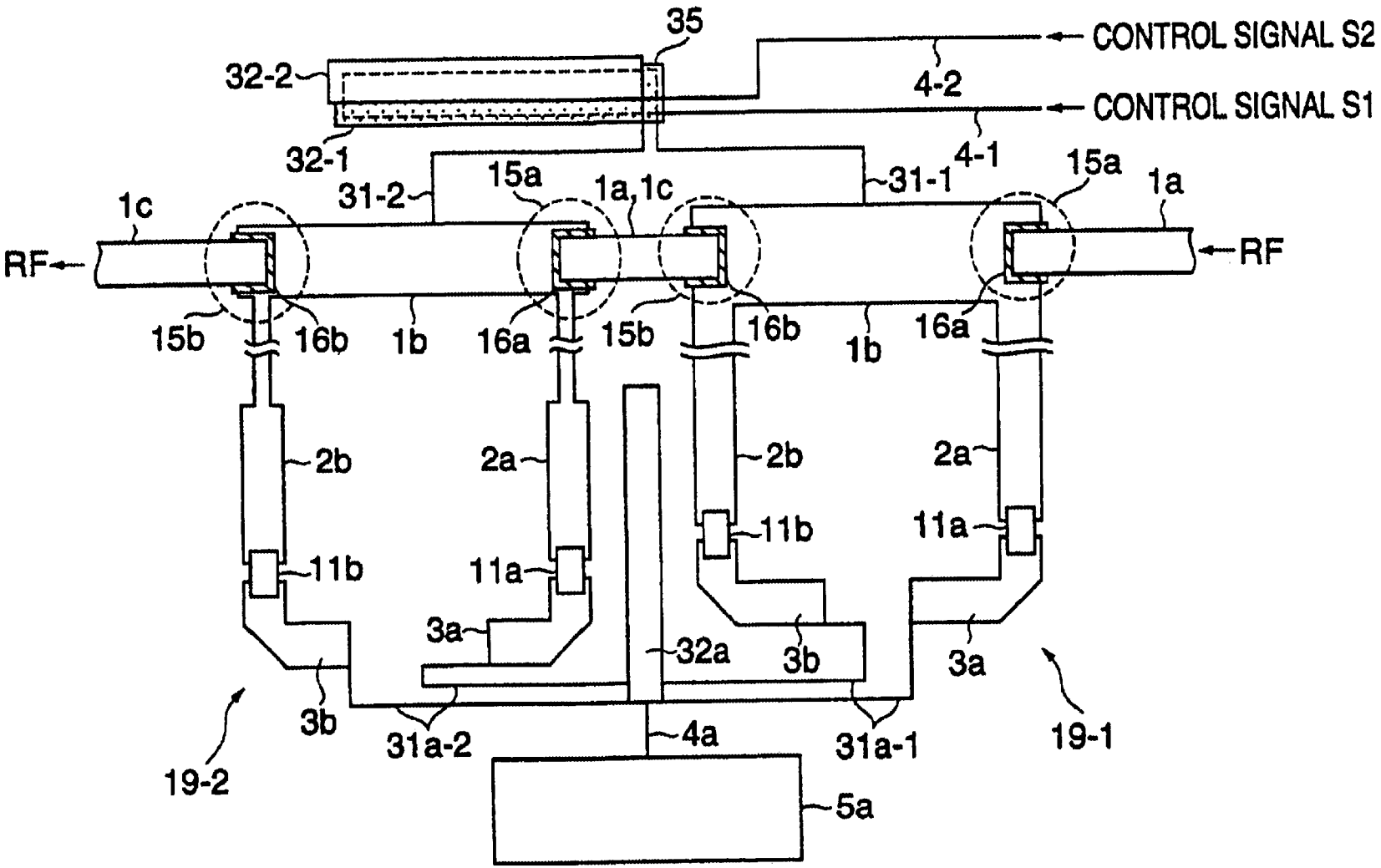
FIG. 36 is a plan view showing a constituent example when two phase shifters are cascade-connected.
Figure 38:
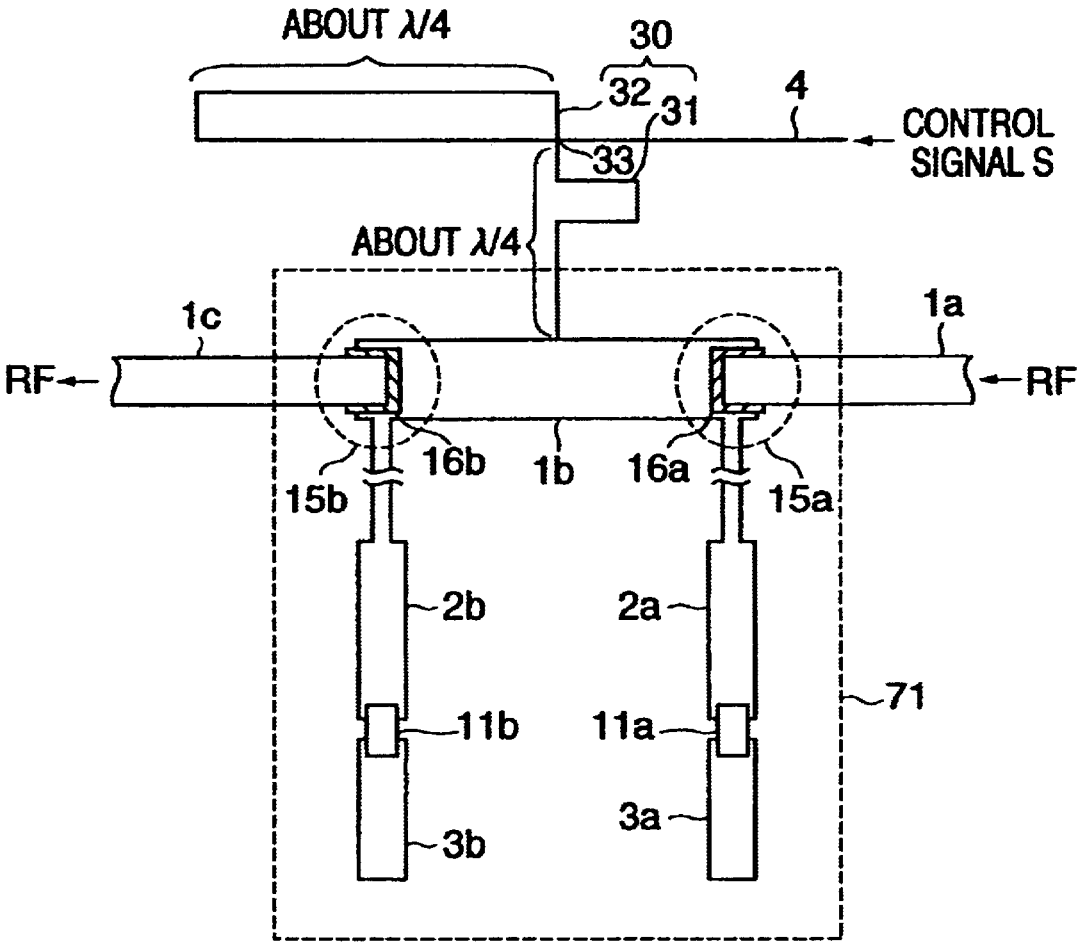
FIG. 38 is a plan view showing an arrangement, in which a phase shifter having been subjected to the chip processing is mounted on a substrate to form the phase shifter shown in FIGS. 15 and 16.

FIG. 36 is a plan view showing a constituent example, in which two phase shifters are cascade-connected to each other. In FIG. 38, the same elements as those in FIGS. 15, 18 and 28 are designated by the same reference numerals and an explanation of the elements are suitably omitted.

Phase-shifters 19-1, 19-2 cascade-connected shown in FIG. 36 present constituent examples of the phase shifter shown in FIG. 28, and the filter 30 shown in FIGS. 15 and 16 is applied as the first and second high-frequency signal blocking units 6, 6*a*. However, the phase shifters 19-1, 19-2 are different in phase-shifting amount from each other.

The low-impedance λ/4 line 32 to constitute the filter 30 needs a comparatively large area. Hereupon, as shown in FIG. 36, for the filter 30 as the second high-frequency signal blocking unit 6*a*, the respective phase shifters 19-1, 19-2 use a single low-impedance λ/4 line 32*a* in common. Thereby, it becomes possible to make the second high-frequency signal blocking unit 6*a* constituted by the filter 30 small in size. In addition, the reference numerals 31*a*-1, 31*a*-2 designate high-impedance λ/4 lines for the phase shifters 19-1, 19-2.

With the filter 30 as the first high-frequency signal blocking unit 6, a low-impedance λ/4 line 32-1 of the phase shifter 19-1 and a low-impedance λ/4 line 32-2 of the phase shifter 19-2 are multi-layered to interpose between the low-impedance λ/4 lines 32-1, 32-2 an insulating film 36 made of $SiO_2$ or the like. Thereby, it is possible to reduce an area occupied by the two low-impedance λ/4 lines 32-1, 32-2. Also, since the respective low-impedance λ/4 lines 32-1, 32-2 are insulated in DC or low frequency fashion, control signals S1, S2 given to the phase shifters 19-1, 19-2 will not get interfered with each other.

In the case of manufacturing the phase shifter shown in FIG. 36, referring to FIGS. 10(A) to 10(E) and FIGS. 11(A) and 11(D), it is possible in the manufacture step (FIG. 10C) of the line 1*b* and the stubs 2*a*, 2*b*, 3*a*, 3*b* or the like to simultaneously manufacture a high-impedance λ/4 line 31-1, the low-impedance λ/4 line 32-1 and a first control signal line 4-1 in the phase shifter 19-1. An insulating film 35 can be manufactured simultaneously in the manufacture step (FIG. 11B) of the insulating films 14, 16*a*, and 16*b*. It is possible in the manufacture step (FIG. 11C) of the lines 1*a*, 1*c* and the cantilevers 11*a*, 11*b* to simultaneously manufacture a high-impedance λ/4 line 31-2, the low-impedance λ/4 line 32-2 and a first control signal line 4-2 in the phase shifter 19-2. In this manner, the phase shifter shown in FIG. 36 can be manufactured with the same number of steps as in the phase shifter shown in FIG. 4.

Figure 37:
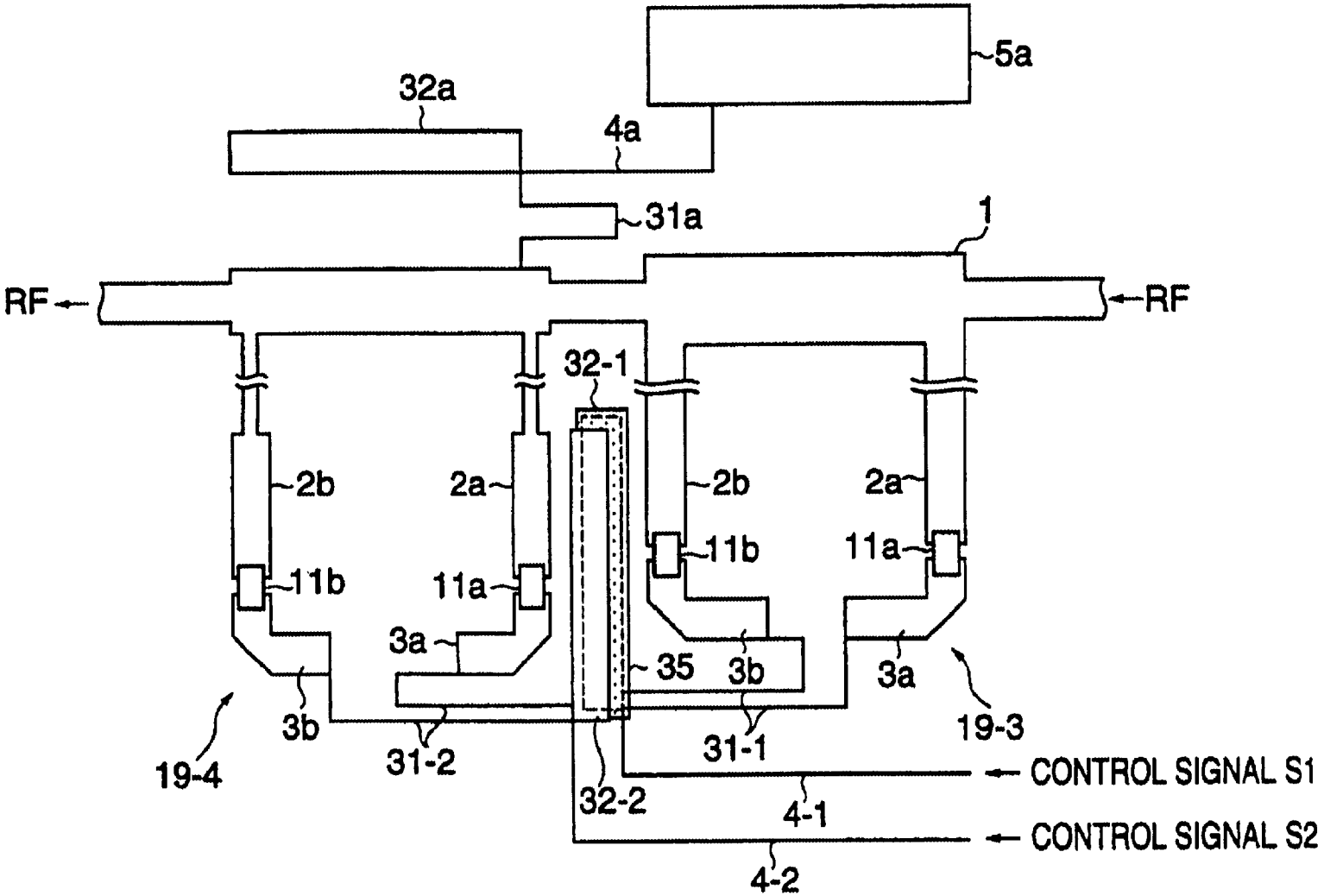
FIG. 37 is a plan view showing another constituent example when two phase shifters are cascade-connected.

FIG. 37 is a plan view showing another constituent example of two phase-shifters cascade-connected. With phase shifters 19-3, 19-4 cascade-connected in FIG. 37, the control signals S1, S2 are applied to the stubs 3*a*, 3*b* as with the phase shifter shown in FIGS. 12 and 13. With this type of phase shifters, the low-impedance λ/4 lines 32-1, 32-2 can be multi-layered to attain miniaturization. In addition, the reference numeral 31*a* designates a high-impedance λ/4 line.

Tenth Embodiment

The phase shifter according to the present invention may be formed on the substrate 10 together with other wiring. With the phase shifter according to the present invention, the microwave circuit (or millimeter wave circuit) may be formed by processing a part or all of the constitution of the phase shifter into chips and loading and mounting the same on the substrate 10. Here, chip processing means a processing, in which a multiplicity of unit circuit are formed together on another substrate with a semiconductor processing and cut every unit circuit, and loaded and mounted on the substrate.

Figure 39:
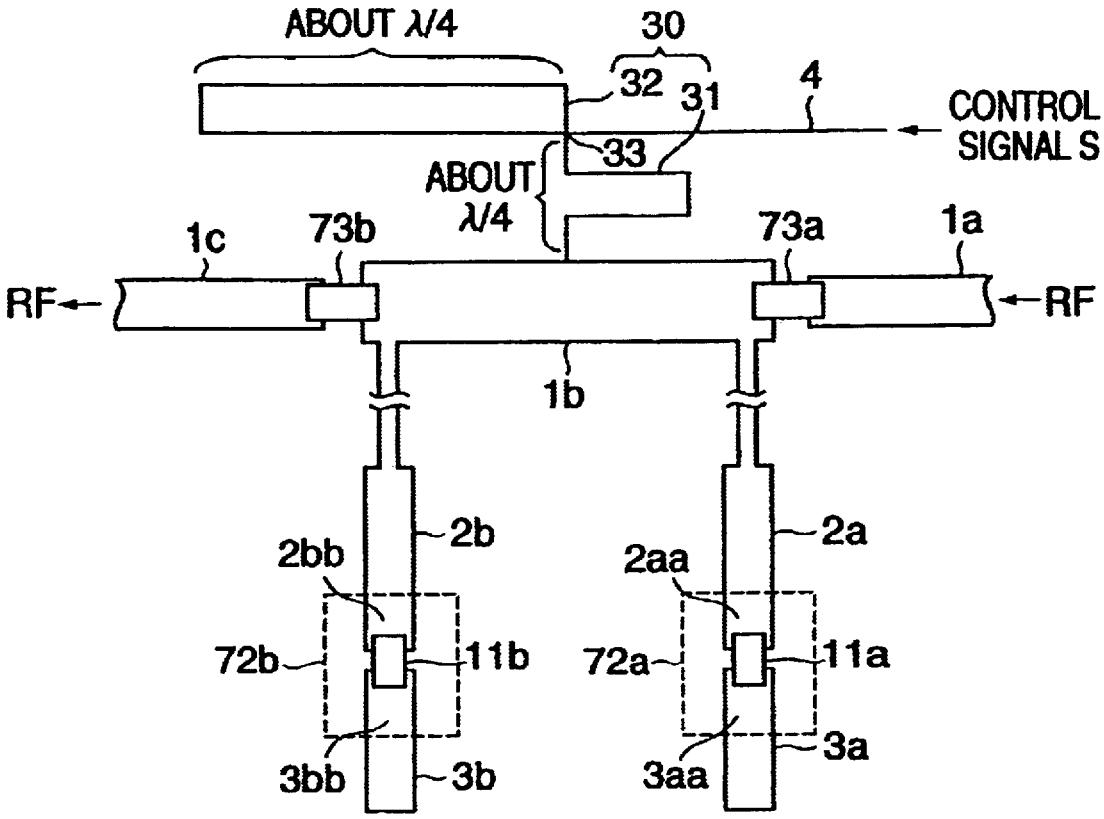
FIG. 39 is a plan view showing another example of the arrangement shown in FIG. 38.

FIGS. 38 and 39 are plan views showing an arrangement, in which a phase shifter having been subjected to the chip processing is mounted on the substrate 10 to complete the phase shifter shown in FIGS. 15 and 16. In FIG. 38, the line 1*b*, which is a part of the main line 1, the stubs 2*a*, 2*b*, 3*a*, 3*b*, the cantilevers 11*a*, 11*b*, and the capacitors 15*a*, 15*b* are subjected to the chip processing to form a chip 71. Meanwhile, the lines 1*a*, 1*c*, which is another part of the main line 1, the high-impedance λ/4 line 31, the low-impedance λ/4 line 32, and the first control signal line 4 have been beforehand laid out on the substrate 10. A function equivalent to that of the phase shifter shown in FIGS. 15 and 16 can be realized by mounting the chip 71 on the substrate 10.

Also, in FIG. 39, the chip processing is carried out on ends 2*aa*, 3*aa* of the stubs 2*a*, 3*a* and the cantilever 11*a* to form a chip 72*a*, and the chip processing is carried out on ends 2*bb*, 3*bb* of the stubs 2*b*, 3*b* and the cantilever 11*b* to form a chip 72*b*.

Meanwhile, the lines 1*a* to 1*c*, which constitute the main line 1, portions of the stubs 2*a*, 2*b*, 3*a*, 3*b* except the ends 2*aa*, 2*bb*, 3*aa*, 3*bb* thereof, the high-impedance λ/4 line 31, the low-impedance λ/4 line 32, and the first control signal line 4 have been beforehand laid out on the substrate 10. A function equivalent to that of the phase shifter shown in FIGS. 15 and 16 can be realized by mounting the chip 72*a*, 72*b* and chip condensers 73*a*, 73*b* as the capacitors 15*a*, 15*b* on the substrate 10.

Examination of defects on the chips 71, 72*a*, 72*b* can be implemented separately by carrying out the chip processing on the phase shifter shown in FIGS. 38 and 39. Thereby, there is produced an advantage that whole circuits, for which the phase shifter is used, can be enhanced in yield.

Eleventh Embodiment

With phase shifter shown in FIG. 4, the insulating films 14 and 14*a* interposed between the underside of the tip end of the arm 13 and the top surface of the tip end of the stub 2*a* are used as the first insulating section for capacitive coupling of the stubs 2*a* and the stub 3*a*. However, the first insulating section can be constituted without the use of the insulating films 14 and 14*a*.

Figure 40:
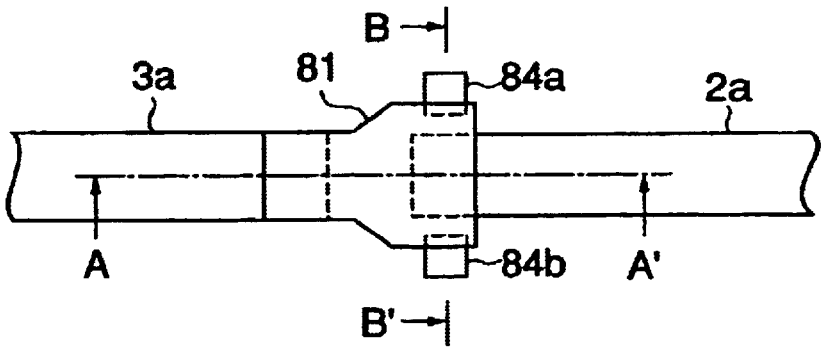
FIG. 40 is a plan view showing another constituent example of the first insulating section.
Figure 41A:
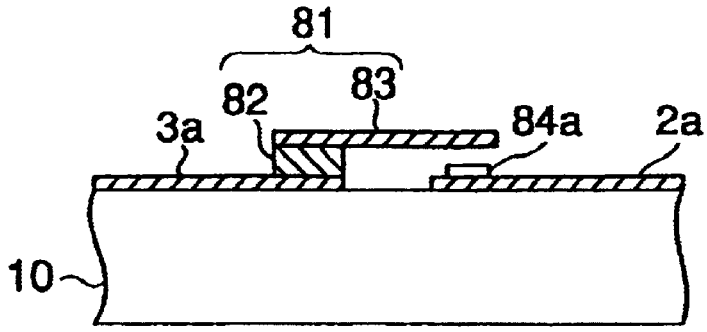
FIGS. 41(A) and 41(B) are cross sectional views showing the first insulating section shown in FIG. 40 at the time of OFF.
Figure 41B:
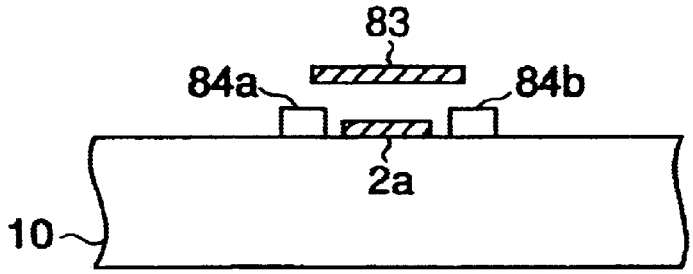
Figure 42A:
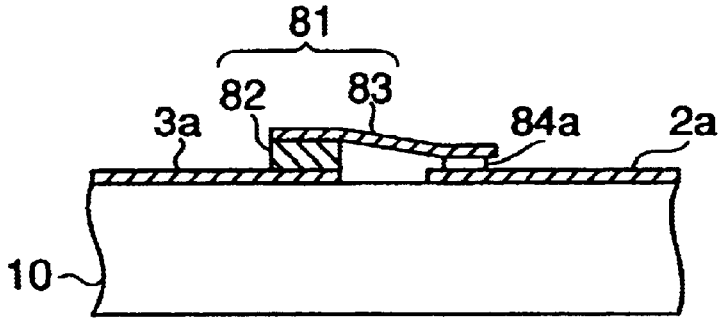
Figure 42B:
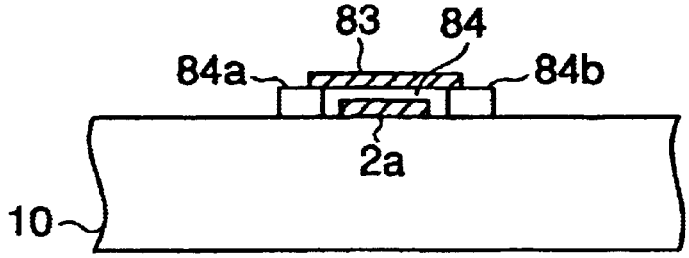

FIG. 40 is a plan view showing another constituent example of the first insulating section. Further, FIGS. 41(A) and 41(B) are cross sectional views showing the first insulating section when OFF, FIG. 41(A) being a cross sectional view taken along the line A-A' in FIG. 40, and FIG. 41(B) being a cross sectional view taken along the line B-B' in FIG. 40. Also, FIGS. 42(A) and 42(B) are cross sectional views showing the first insulating section when ON, FIG. 42(A) being a cross sectional view taken along the line A-A' in FIG. 40, and FIG. 42(B) being a cross sectional view taken along the line B-B' in FIG. 40.

As shown in FIG. 40, projections 84*a*, 84*b*, respectively, are arranged on and separated from both sides of the end of the stub 2*a*. As shown in FIGS. 41(A) and 41(B), the projections 84*a*, 84*b* are formed to have a slightly greater (higher) thickness than that of the stub 2*a*. The projections 84*a*, 84*b* may be formed from any one of dielectrics, semiconductors, and conductors.

Meanwhile, a post 82 is formed on the end of the stub 3*a*, and a base portion of an arm 83 is fixed to a top surface of the post 82. The arm 83 extends from the top surface of the post 82 to bridge across a gap and extends to above the end of the stub 2*a*. However, the arm 83 is larger in width at a tip end thereof than at the base portion thereof so that the tip end of the arm 83 face both of the projections 84*a*, 84*b* as shown in FIG. 40.

With such arrangement, when attractive forces based on the control signal S are generated between the stub 2*a* and the arm 83, the tip end of the arm 83 is drawn toward the stub 2*a* by the attractive forces. However, the projections 84*a*, 84*b* function as stoppers, so that displacement of the arm 83 is stopped at the top surfaces of the projections 84*a*, 84*b* as shown in FIGS. 42(A) and 42(B). At this time, a thin air layer 84 is formed between the stub 2*a* and the arm 83. Presence of the air layer 84 causes the stub 2*a* and the arm 83 to be insulated from each other in DC or low frequency fashion, but the stub 2*a* and the arm 83 are coupled in high-frequency fashion because the air layer 84 is sufficiently small in thickness.

As described above, with the phase shifter according to the present invention, the cantilever of the micro-machine switch is fixedly mounted on the distributed constant line, and the first control signal is directly applied to the distributed constant line to have the same acting as a control electrode of the micro-machine switch. Thereby, posts, arms and upper and lower electrodes, which have been necessary in conventional micro-machine switches, are dispensed with, and hence it is possible to make a micro-machine switch small in size. Accordingly, a phase shifter, in which a micro-machine switch is used as a switching element, can be made small in size as a whole. Also, the micro-machine switch is simple in construction, and so phase shifters can be manufactured in the small number of processes.

Also, leak of the high-frequency signal to the first control signal line can be prevented by connecting to the first control signal line the first high-frequency signal blocking unit for blocking passage of the high-frequency signal. Accordingly, insertion loss of a micro-machine switch can be reduced. Also, a circuit, in which the phase shifter is used, can be improved in high-frequency characteristics since electromagnetic coupling of the first control signal line with other lines can be prevented.

Also, the fourth control signal line is connected to that one of the first and second distributed constant lines contained in the phase shifter, to which the first control signal is not applied, and charging and discharging of electric charges generated by electrostatic induction is effected through the fourth control signal line. Thereby, the micro-machine switch becomes stable in switching action and rapid in switching speed, so that the phase shifter can be surely and rapidly switched in phase-shifting amount.

Also, the fourth control signal line is connected to that one of the distributed constant lines, to which the first control signal is not applied, and voltage of reverse polarity to that of the first control signal is applied, whereby voltage of the first control signal can be reduced in level to suppress generation of surge and noises.

In these cases, the second high-frequency signal blocking unit for blocking passage of the high-frequency signal is connected to the fourth control signal line to thereby enable preventing leak of the high-frequency signal to the fourth control signal line. Accordingly, problems such as an increase in insertion loss and degradation of the high-frequency characteristics will not be caused.

Also, in the case where the first and second high-frequency signal blocking units are constituted by a bias tee making use of capacitors, the constitution can be simplified by sharing of constituent parts.

INDUSTRIAL APPLICABILITY

Various embodiments of the phase shifter according to the present invention have been described above. The phase shifter according to the present invention can be used in, for example, phased-array antennas.

What is claimed is:

1. A phase shifter for switching passing phase of a high-frequency signal by means of ON/OFF control of a micro-machine switch, the micro-machine switch comprising:

first and second distributed constant lines arranged on a substrate to be spaced from each other, a first control signal line connected electrically to the first or second distributed constant lines for application of a first control signal composed of a binary change in voltage, a cantilever, one end of which is fixed to one of the first and second distributed constant lines and the other end of which is formed to be capable of coming toward and away from the other of the first and second distributed constant lines, the cantilever comprising an electrically conductive member, a first insulating section formed in a region where the other of the first and second distributed constant lines faces the cantilever, and a second insulating section for maintaining a voltage value of the first control signal.

2. The phase shifter according to claim 1, wherein the first insulating section comprises an insulating film formed on at least one of an upper surface of the other of the first and second distributed constant lines and an underside of the cantilever.

3. The phase shifter according to claim 1, further comprising a first high-frequency signal blocking unit connected to the first control signal line to block passage of the high-frequency signal.

4. The phase shifter according to claim 3, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a low-impedance line connected at one end thereof to the other end of the high-impedance line and opened at the other end thereof, and having an electric length of about one fourth as long as a wavelength of the high-frequency signal and a smaller characteristic impedance than that of the high-impedance line, and wherein the first control signal line is connected to the other end of the high-impedance line.

5. The phase shifter according to claim 3, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a capacitor having a first electrode and second electrode, with one of the first and second electrodes connected to the other end of the high-impedance line and the other of the first and second electrodes connected to a grounding, and wherein the first control signal line is connected to the other end of the high-impedance line.

6. The phase shifter according to claim 3, wherein the first high-frequency signal blocking unit comprises an inductance element.

7. The phase shifter according to claim 3, wherein the first high-frequency signal blocking unit comprises a resistor element having a sufficiently greater impedance than characteristic impedance of the first and second distributed constant lines.

8. The phase shifter according to claim 7, wherein the resistor element is insertion connected in series to the first control signal line.

9. The phase shifter according to claim 7, wherein the resistor element is connected at one end thereof to the first control signal line and opened at the other end thereof.

10. The phase shifter according to claim l, further comprising a second control signal line connected electrically to that one of the first and second distributed constant lines, to which the first control signal line is not connected electrically, for charging and discharging electric charges generated by electrostatic induction.

11. The phase shifter according to claim 1, further comprising:

a second control signal line connected electrically to that one of the first and second distributed constant lines, to which the first control signal line is not connected electrically, and for applying a constant voltage having a reverse polarity to that of the first control signal, and a third insulating section formed on that one of the first and second distributed constant lines, to which the second control signal line is connected electrically, and for maintaining a voltage value of the constant voltage applied from the second control signal line.

12. The phase shifter according to claim 10, further comprising a second high-frequency signal blocking unit connected to the second control signal line to block passage of the high-frequency signal.

13. The phase shifter according to claim 11, further comprising a high-frequency signal blocking unit connected to the second control signal line to block passage of the high-frequency signal.

14. The phase shifter according to claim 12 or 13, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a low-impedance line connected at one end thereof to the other end of the high-impedance line and opened at the other end thereof, and having an electric length of about one fourth as long as a wavelength of the high-frequency signal and a smaller characteristic impedance than that of the high-impedance line, and wherein the second control signal line is connected to the other end of the high-impedance line.

15. The phase shifter according to claim 12 or 13, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a capacitor having a first electrode and second electrode, wherein one of the first and second electrodes is connected to the other end of the high-impedance line, and the other of the first and second electrodes is connected to a grounding, and wherein the second control signal line is connected to the other end of the high-impedance line.

16. The phase shifter according to claim 12 or 13, wherein the high-frequency signal blocking unit comprises an inductance element.

17. The phase shifter according to claim 12 or 13, wherein the high-frequency signal blocking unit comprises a resistor element having a sufficiently greater impedance than characteristic impedance of the first and second distributed constant lines.

18. The phase shifter according to claim 17, wherein the resistor element is insertion connected in series to the second control signal line.

19. The phase shifter according to claim 17, wherein the resistor element is connected at one end thereof to the second control signal line and opened at the other end thereof.

20. The phase shifter according to claim 1, further comprising first and second high-impedance lines connected at one end thereof to the first and second distributed constant lines, and having an electric length of about one fourth as long as a wavelength of the high-frequency signal and a greater characteristic impedance than those of the first and second distributed constant lines, and a capacitor having a first electrode and second electrode, with one of the first and second electrodes connected to the other end of the first high-impedance line and the other of first and second electrodes connected to the other end of the second high-impedance line, wherein the first high-impedance line is connected at the other end thereof to the first control signal line, and wherein the second high-impedance line is connected at the other end thereof to a grounding.

21. A phase shifter comprising:

a main line, through which a high-frequency signal is transmitted, a first distributed constant line connected to the main line and opened at a tip end thereof, a second distributed constant line arranged to be spaced from the tip end of the first distributed constant line and opened at a tip end thereof, a cantilever, one end of which is fixed to one of the first and second distributed constant lines and the other end of which is formed to be capable of coming toward and away from the other of the first and second distributed constant lines, the cantilever comprising an electrically conductive member, a first control signal line connected electrically to the first or second distributed constant line and for applying of a first control signal composed of a binary change in voltage, a first insulating section formed in a region where the other of the first and second distributed constant lines faces the cantilever, and a second insulating section for maintaining a voltage value of the first control signal.

22. The phase shifter according to claim 21, wherein the second insulating section comprises two capacitors formed midway in the main line, and the first distributed constant line and the first control signal line are both connected electrically to the main line between the two capacitors.

23. The phase shifter according to claim 21, wherein the first control signal line is connected electrically to the second distributed constant line, and the second insulating section is composed of the opened end of the second distributed constant line.

24. The phase shifter according to claim 21, wherein the first insulating section comprises an insulating film formed on at least one of an upper surface of the other of the first and second distributed constant lines and an underside of the cantilever.

25. The phase shifter according to claim 21, further comprising a first high-frequency signal blocking unit connected to the first control signal line to block passage of the high-frequency signal.

26. The phase shifter according to claim 25, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a low-impedance line connected at one end thereof to the other of the high-impedance line and opened at the other end thereof, and having an electric length of about one fourth as long as a wavelength of the high-frequency signal and a smaller characteristic impedance than that of the high-impedance line, and wherein the first control signal line is connected to the other end of the high-impedance line.

27. The phase shifter according to claim 25, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a capacitor having a first electrode and a second electrode, wherein one of the first and second electrodes is connected to the other end of the high-impedance line, and the other end of electrodes is connected to a grounding, and wherein the first control signal line is connected to the other end of the high-impedance line.

28. The phase shifter according to claim 25, wherein the first high-frequency signal blocking unit comprises an inductance element.

29. The phase shifter according to claim 25, wherein the first high-frequency signal blocking unit comprises a resistor element having a sufficiently greater impedance than those of the first and second distributed constant lines.

30. The phase shifter according to claim 29, wherein the resistor element is insertion connected in series to the first control signal line.

31. The phase shifter according to claim 29, wherein the resistor element is connected at one end thereof to the first control signal line and opened at the other end thereof.

32. The phase shifter according to claim 21, further comprising a second control signal line connected electrically to that one of the first and second distributed constant lines, to which the first control signal line is not connected, for charging and discharging electric charges generated by electrostatic induction.

33. The phase shifter according to claim 21, further comprising:

a second control signal line connected electrically to that one of the first and second distributed constant lines, to which the first control signal line is not connected electrically, for applying a constant voltage of reverse polarity to that of the first control signal, and a third insulating section formed on that one of the first and second distributed constant lines, to which the second control signal line is connected electrically, for maintaining a voltage value of the constant voltage applied from the second control signal line.

34. The phase shifter according to claim 32, further comprising a high-frequency signal blocking unit connected to the second control signal line to block passage of the high-frequency signal.

35. The phase shifter according to claim 33, further comprising a high-frequency signal blocking unit connected to the second control signal line to block passage of the high-frequency signal.

36. The phase shifter according to claim 34 or 35, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a low-impedance line connected at one end thereof to the other end of the high-impedance line and opened at the other end thereof, and having an electric length of about one fourth as long as a wavelength of the high-frequency signal and a smaller characteristic impedance than that of the high-impedance line, and wherein the second control signal line is connected to the other end of the high-impedance line.

37. The phase shifter according to claim 34 or 35, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the high-impedance line and the other of the first and second electrodes connected to a grounding, and wherein the second control signal line is connected to the other end of the high-impedance line.

38. The phase shifter according to claim 34 or 35, wherein the high-frequency signal blocking unit comprises an inductance element.

39. The phase shifter according to claim 34 or 35, wherein the high-frequency signal blocking unit comprises a resistor element having a sufficiently greater impedance than those of the first and second distributed constant lines.

40. The phase shifter according to claim 39, wherein the resistor element is insertion connected in series to the second control signal line.

41. The phase shifter according to claim 39, wherein the resistor element is connected at one end thereof to the second control signal line and opened at the other end thereof.

42. The phase shifter according to claim 21, further comprising first and second high-impedance lines connected at one ends thereof to the first and second distributed constant lines, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the first high-impedance line and the other of the first and second electrodes connected to the other end of the second high-impedance line, wherein the first high-impedance line is connected at the other end thereof to the first control signal line, and wherein the second high-impedance line is connected at the other end thereof to a grounding.

43. A phase shifter comprising:

a main line, through which a high-frequency signal is transmitted, a first distributed constant line connected to the main line and opened at a tip end thereof, a grounding arranged to be spaced from the tip end of the first distributed constant line, a cantilever, one end of which is fixed to one of the first and second distributed constant lines and the other end of which is formed to be capable of coming toward and away from the other of the first and second distributed constant lines, the cantilever comprising an electrically conductive member, a first control signal line connected electrically to the first or second distributed constant line and for applying of a first control signal composed of a binary change in voltage, a first insulating section formed in a region where the other of the first and second distributed constant lines faces the cantilever, and a second insulating section for maintaining a voltage value of the first control signal.

44. The phase shifter according to claim 43, wherein the second insulating section comprises two capacitors formed midway in the main line, and the first distributed constant line and the first control signal line are both connected electrically to the main line between the two capacitors.

45. The phase shifter according to claim 43, wherein the first control signal line is connected electrically to the second distributed constant line, and the second insulating section is composed of the opened end of the second distributed constant line.

46. The phase shifter according to claim 43, wherein the first insulating section comprises an insulating film formed on at least one of an upper surface of the other of the first and second distributed constant lines and an underside of the cantilever.

47. The phase shifter according to claim 43, further comprising a first high-frequency signal blocking unit connected to the first control signal line to block passage of the high-frequency signal.

48. The phase shifter according to claim 47, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a low-impedance line connected at one end thereof to the other of the high-impedance line and opened at the other end thereof, and having an electric length of about one fourth as long as a wavelength of the high-frequency signal and a smaller characteristic impedance than that of the high-impedance line, and wherein the first control signal line is connected to the other end of the high-impedance line.

49. The phase shifter according to claim 47, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the high-impedance line and the other of the first and second electrodes connected to a grounding, and wherein the first control signal line is connected to the other end of the high-impedance line.

50. The phase shifter according to claim 47, wherein the first high-frequency signal blocking unit comprises an inductance element.

51. The phase shifter according to claim 47, wherein the first high-frequency signal blocking unit comprises a resistor element having a sufficiently greater impedance than those of the first and second distributed constant lines.

52. The phase shifter according to claim 51, wherein the resistor element is insertion connected in series to the first control signal line.

53. The phase shifter according to claim 51, wherein the resistor element is connected at one end thereof to the first control signal line and opened at the other end thereof.

54. The phase shifter according to claim 43, further comprising a second control signal line connected electrically to that one of the first and second distributed constant lines, to which the first control signal line is not connected electrically, for charging and discharging electric charge generated by electrostatic induction.

55. The phase shifter according to claim 43, further comprising:

a second control signal line connected electrically to that one of the first and second distributed constant lines, to which the first control signal line is not connected electrically, and for applying of constant voltage having a reverse polarity to that of the first control signal, and a third insulating section formed on that one of the first and second distributed constant lines, to which the second control signal line is connected electrically, and for maintaining a voltage value of the constant voltage applied from the second control signal line.

56. The phase shifter according to claim 54, further comprising a high-frequency signal blocking unit connected to the second control signal line to block passage of the high-frequency signal.

57. The phase shifter according to claim 55, further comprising a high-frequency signal blocking unit connected to the second control signal line to block passage of the high-frequency signal.

58. The phase shifter according to claim 56 or 57, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a low-impedance line connected at one end thereof to the other end of the high-impedance line and opened at the other end thereof, and having an electric length of about one fourth as long as a wavelength of the high-frequency signal and a smaller characteristic impedance than that of the high-impedance line, and wherein the second control signal line is connected to the other end of the high-impedance line.

59. The phase shifter according to claim 56 or 57, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the high-impedance line and the other of the first and second electrodes connected to a grounding, and wherein the second control signal line is connected to the other end of the high-impedance line.

60. The phase shifter according to claim 56 or 57, wherein the high-frequency signal blocking unit comprises an inductance element.

61. The phase shifter according to claim 56 or 57, wherein the high-frequency signal blocking unit comprises a resistor element having a sufficiently greater impedance than characteristic impedance of the first and second distributed constant lines.

62. The phase shifter according to claim 61, wherein the resistor element is insertion connected in series to the second control signal line.

63. The phase shifter according to claim 61, wherein the resistor element is connected at one end thereof to the second control signal line and opened at the other end thereof.

64. The phase shifter according to claim 43, further comprising first and high-impedance lines connected at one ends thereof to the first and second distributed constant lines, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the first high-impedance line and the other of the first and second electrodes connected to the other end of the second high-impedance line, wherein the first high-impedance line is connected at the other end thereof to the first control signal line, and wherein the high-impedance line is connected at the other end thereof to a grounding.

65. A phase shifter including a first distributed constant line with a cut part, two second distributed constant lines having different electric length from each other, and a micro-machine switch for switching the second distributed constant lines, which short-circuits the cut part of the first distributed constant line to vary passing phase of a high-frequency signal, the micro-machine switch comprising:

cantilevers provided for every second distributed constant line, one end of the cantilevers being fixed to one of the first and second distributed constant lines and the other end of the cantilevers being formed to be capable of coming toward and away from the other of the first and second distributed constant lines, the cantilevers comprising electrically conductive members, a second control signal line connected electrically to one of the second distributed constant lines for application of a second control signal composed of a binary change in voltage, a third control signal line connected electrically to the other of the second distributed constant lines for application of a third control signal complementary to the second control signal, first insulating sections, respectively, formed in regions where the other of the first and second distributed constant lines faces the cantilevers, and a second insulating section for maintaining a voltage value of the second and third control signals.

66. The phase shifter according to claim 65, wherein the cantilevers, respectively, are provided on both ends of the respective second distributed constant lines.

67. The phase shifter according to claim 65, wherein the first insulating section comprises an insulating film formed on at least one of an upper surface of the other of the first and second distributed constant lines and an underside of the cantilever.

68. The phase shifter according to claim 65, further comprising a first high-frequency signal blocking unit connected to the first control signal line to block passage of the high-frequency signal.

69. The phase shifter according to claim 65, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a low-impedance line connected at one end thereof to the other of the high-impedance line and opened at the other end thereof, and having an electric length of about one fourth as long as a wavelength of the high-frequency signal and a smaller characteristic impedance than that of the high-impedance line, and wherein the first control signal line is connected to the other end of the high-impedance line.

70. The phase shifter according to claim 65, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a capacitor with one of electrodes connected to the other of the high-impedance line and the other of electrodes connected to a grounding, and wherein the first control signal line is connected to the other end of the high-impedance line.

71. The phase shifter according to claim 65, wherein the first high-frequency signal blocking unit comprises an inductance element.

72. The phase shifter according to claim 65, wherein the first high-frequency signal blocking unit comprises a resistor element having a sufficiently greater impedance than characteristic impedance of the first and second distributed constant lines.

73. The phase shifter according to claim 72, wherein the resistor element is insertion connected in series to the first control signal line.

74. The phase shifter according to claim 72, wherein the resistor element is connected at one end thereof to the first control signal line and opened at the other end thereof.

75. The phase shifter according to claim 65, further comprising a fourth control signal line connected electrically to that one of the first and second distributed constant lines, to which the first control signal line is not connected electrically, for charging and discharging electric charges generated by electrostatic induction.

76. The phase shifter according to claim 65, further comprising:

a fourth control signal line connected electrically to that one of the first and second distributed constant lines, to which the first control signal line is not connected electrically, and for applying of constant voltage having a reverse polarity to that of the first control signal, and a third insulating section formed on that one of the first and second distributed constant lines, to which the fourth control signal line is connected electrically, and for maintaining a voltage value of the constant voltage applied from the fourth control signal line.

77. The phase shifter according to claim 75, further comprising a high-frequency signal blocking unit connected to the fourth control signal line to block passage of the high-frequency signal.

78. The phase shifter according to claim 76, further comprising a high-frequency signal blocking unit connected to the fourth control signal line to block passage of the high-frequency signal.

79. The phase shifter according to claim 77 or 78, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a low-impedance line connected at one end thereof to the other end of the high-impedance line and opened at the other end thereof, and having an electric length of about one fourth as long as a wavelength of the high-frequency signal and a smaller characteristic impedance than that of the high-impedance line, and wherein the fourth control signal line is connected to the other end of the high-impedance line.

80. The phase shifter according to claim 77 or 78, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the high-impedance line and the other of the first and second electrodes connected to a grounding, and wherein the fourth control signal line is connected to the other end of the high-impedance line.

81. The phase shifter according to claim 77 or 78, wherein the high-frequency signal blocking unit comprises an inductance element.

82. The phase shifter according to claim 77 or 78, wherein the high-frequency signal blocking unit comprises a resistor element having a sufficiently greater impedance than characteristic impedance of the first and second distributed constant lines.

83. The phase shifter according to claim 82, wherein the resistor element is insertion connected in series to the fourth control signal line.

84. The phase shifter according to claim 82, wherein the resistor element is connected at one end thereof to the fourth control signal line and opened at the other end thereof.

85. The phase shifter according to claim 65, further comprising first and high-impedance lines connected at one ends thereof to the first and second distributed constant lines, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the first high-impedance line and the other of the first and second electrodes connected to the other end of the second high-impedance line, wherein the first high-impedance line is connected at the other end thereof to the first control signal line, and wherein the second high-impedance line is connected at the other end thereof to a grounding.

86. A phase shifter including a first distributed constant line with a cut part, two second distributed constant lines having different electric length from each other, and a micro-machine switch for switching the second distributed constant lines, which short-circuit the cut part of the first distributed constant line to vary passing phase of a high-frequency signal, the micro-machine switch comprising:

cantilevers provided for every second distributed constant line, one end of the cantilevers being fixed to one of the first and second distributed constant lines and the other end of the cantilevers being formed to be capable of coming toward and away from the other of the first and second distributed constant lines, the cantilevers comprising electrically conductive members, a first control signal line connected electrically to the first distributed constant line for application of a first control signal composed of a binary change in voltage, first insulating sections, respectively, formed in regions where the other of the first and second distributed constant lines faces the cantilevers, and a second insulating section for maintaining a voltage value of the first control signal, and wherein constant voltages, respectively, equivalent to respective voltage values of two states of the first control signal are applied to the respective second distributed constant lines.

87. The phase shifter according to claim 86, wherein the cantilevers, respectively, are provided on both ends of the respective second distributed constant lines.

88. The phase shifter according to claim 86, wherein the first insulating section comprises an insulating film formed on at least one of an upper surface of the other of the first and second distributed constant lines and an underside of the cantilever.

89. The phase shifter according to claim 86, further comprising a first high-frequency signal blocking unit connected to the first control signal line to block passage of the high-frequency signal.

90. The phase shifter according to claim 89, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a low-impedance line connected at one end thereof to the other of the high-impedance line and opened at the other end thereof, and having an electric length of about one fourth as long as a wavelength of the high-frequency signal and a smaller characteristic impedance than that of the high-impedance line, and wherein the first control signal line is connected to the other end of the high-impedance line.

91. The phase shifter according to claim 89, wherein the first high-frequency signal blocking unit comprises:

a high-impedance line connected at one end thereof to that one of the first and second distributed constant lines, to which the first control signal line is connected electrically, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the high-impedance line and the other of the first and second electrodes connected to a grounding, and wherein the first control signal line is connected to the other end of the high-impedance line.

92. The phase shifter according to claim 89, wherein the first high-frequency signal blocking unit comprises an inductance element.

93. The phase shifter according to claim 89, wherein the first high-frequency signal blocking unit comprises a resistor element having a sufficiently greater impedance than characteristic impedance of the first and second distributed constant lines.

94. The phase shifter according to claim 93, wherein the resistor element is insertion connected in series to the first control signal line.

95. The phase shifter according to claim 93, wherein the resistor element is connected at one end thereof to the first control signal line and opened at the other end thereof.

96. The phase shifter according to claim 86, further comprising a second control signal line connected electrically to that one of the first and second distributed constant lines, to which the first control signal line is not connected, and for charging and discharging electric charges generated by electrostatic induction.

97. The phase shifter according to claim 86, further comprising:

a second control signal line connected electrically to that one of the first and second distributed constant lines, to which the first control signal line is not connected electrically, and for applying of constant voltage having a reverse polarity to that of the first control signal, and a third insulating section formed on that one of the first and second distributed constant lines, to which the fourth control signal line is connected electrically, and for maintaining a voltage value of the constant voltage applied from the second control signal line.

98. The phase shifter according to claim 96, further comprising a high-frequency signal blocking unit connected to the second control signal line to block passage of the high-frequency signal.

99. The phase shifter according to claim 97, further comprising a high-frequency signal blocking unit connected to the second control signal line to block passage of the high-frequency signal.

100. The phase shifter according to claim 98 or 99, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a low-impedance line connected at one end thereof to the other end of the high-impedance line and opened at the other end thereof, and having an electric length of about one fourth as long as a wavelength of the high-frequency signal and a smaller characteristic impedance than that of the high-impedance line, and wherein the second control signal line is connected to the other end of the high-impedance line.

101. The phase shifter according to claim 98 or 99, wherein the high-frequency signal blocking unit comprises:

a high-impedance line connected at one end thereof to that one of the first and second distributed constant lines, to which the first control signal line is not connected electrically, and having an electric length of about one fourth as long as a wavelength of the high-frequency signal and a greater characteristic impedance than those of the first and second distributed constant lines, and a capacitor having a first electrode and a second electrode, with one of the first and second electrodes connected to the other end of the high-impedance line and the other of the first and second electrodes connected to a grounding, and wherein the second control signal line is connected to the other end of the high-impedance line.

102. The phase shifter according to claim 98 or 99, wherein the high-frequency signal blocking unit comprises an inductance element.

103. The phase shifter according to claim 98 or 99, wherein the high-frequency signal blocking unit comprises a resistor element having a sufficiently greater impedance than those of the first and second distributed constant lines.

104. The phase shifter according to claim 103, wherein the resistor element is insertion connected in series to the second control signal line.

105. The phase shifter according to claim 103, wherein the resistor element is connected at one end thereof to the second control signal line and opened at the other end thereof.

106. The phase shifter according to claim 86, further comprising first and high-impedance lines connected at one ends thereof to the first and second distributed constant lines, and having an electric length of about one fourth as long as a wavelength of the high-frequency signal and a greater characteristic impedance than those of the first and second distributed constant lines, and a capacitor having a first electrode and second electrode, with one of the first and second electrodes connected to the other end of the first high-impedance line and the other of the first and second electrodes connected to the other end of the high-impedance line, wherein the first high-impedance line is connected at the other end thereof to the first control signal line, and wherein the high-impedance line is connected at the other end thereof to a grounding.

107. A method of manufacturing a phase shifter, comprising:

a first step of forming on a substrate a portion of a main line, a first distributed constant line connected to the portion of the main line, a second distributed constant line, an end of which is spaced from an end of the first distributed constant line, and a control signal line connected to the portion of the main line;

a second step of forming a sacrificing layer in a region extending from a gap between the first and second distributed constant lines to the end of the first or second distributed constant line;

a third step of forming a first insulating film on that portion of the sacrificing layer, which faces the end of the first or second distributed constant line, and a second insulating film on both ends of the portion of the main line;

a fourth step of forming a cantilever of metal on an area extending from that end of the second or first distributed constant line, on which the sacrificing layer is not formed, to the first insulating film on the sacrificing layer, and at the same time forming other portions of the main line on the second insulating film and the substrate; and a fifth step of removing the sacrificing layer.

* * * * *